US010255900B2

(12) United States Patent
DeGrandis et al.

(10) Patent No.: US 10,255,900 B2
(45) Date of Patent: Apr. 9, 2019

(54) SYSTEMS, APPARATUSES, AND METHODS FOR SOUND DIFFUSION

(71) Applicant: ACOUSTICS FIRST CORPORATION, Richmond, VA (US)

(72) Inventors: James John DeGrandis, Williamsburg, VA (US); Samuel Jennings Colleran, Richmond, VA (US)

(73) Assignee: ACOUSTIC FIRST CORPORATION, Richmond, VA (US)

( * ) Notice: Subject to any disclaimer, the term of this patent is extended or adjusted under 35 U.S.C. 154(b) by 0 days.

(21) Appl. No.: 15/406,259

(22) Filed: Jan. 13, 2017

(65) Prior Publication Data

US 2017/0206884 A1 Jul. 20, 2017

Related U.S. Application Data

(60) Provisional application No. 62/278,746, filed on Jan. 14, 2016.

(51) Int. Cl.

| | |
|---|---|
| ***G10K 11/20*** | (2006.01) |
| ***E04B 1/99*** | (2006.01) |
| *G10K 11/18* | (2006.01) |

(52) U.S. Cl.
CPC ..... *G10K 11/20* (2013.01)

(58) Field of Classification Search
CPC ..... G10K 11/20; G10K 11/18; G10K 11/26; G10K 11/28; E04B 2001/8433; E04B 2001/8438; E04B 2001/848; E04B 2001/8485; E04B 2001/849; E04B 1/99
See application file for complete search history.

(56) References Cited

U.S. PATENT DOCUMENTS 3,411,605 A * 11/1968 Coffman ..... E04B 1/994 181/30
3,712,413 A 1/1973 Eckel
4,122,915 A * 10/1978 Taguchi ..... E04B 1/84 181/210
4,207,964 A * 6/1980 Taguchi ..... E04B 1/84 181/210
4,548,292 A * 10/1985 Noxon ..... E04B 1/84 181/286
5,035,298 A 7/1991 Noxon
5,137,111 A * 8/1992 Diduck ..... E04B 1/8209 181/286
5,160,816 A * 11/1992 Chlop ..... E04B 1/84 181/285

(Continued)

*Primary Examiner* — Edgardo San Martin
(74) *Attorney, Agent, or Firm* — Oblon, McClelland, Maier & Neustadt, L.L.P.

(57) ABSTRACT

Systems, apparatuses, and methods for diffusing sound can comprise a sound or acoustic diffuser or a plurality of sound or acoustic diffusers. The acoustic diffuser can be provided as a 90 degree segment to fit into an inside corner, and a plurality of 90 degree segments can be arranged relative to each other to effectively provide 180 degree, 270 degree, or 360 degree contiguous acoustic diffusers, where the 180 degree acoustic diffuser can be arranged relative to a flat wall, and the 270 degree acoustic diffuser can be arranged relative to an outside corner. Furthermore, each 90 degree segment, or contiguous combination of segments, can have vertically stacked thereon (or be vertically stacked on) another segment of same construction, in freestanding fashion.

20 Claims, 19 Drawing Sheets

(56) References Cited

U.S. PATENT DOCUMENTS 5,210,383 A * 5/1993 Noxon ..... E04B 1/8209 181/290
5,317,113 A * 5/1994 Duda ..... E04B 1/84 181/285
5,401,921 A * 3/1995 D'Antonio ..... G10K 11/20 181/286
5,444,198 A * 8/1995 Gallas ..... E04B 1/8209 181/295
5,579,614 A 12/1996 Dorn
5,764,782 A * 6/1998 Hayes ..... B62D 35/00 181/155
5,969,301 A * 10/1999 Cullum, Jr. ..... E04B 1/86 181/286
5,992,561 A 11/1999 Holben
6,015,026 A * 1/2000 McGrath ..... B32B 5/26 181/286
6,073,722 A * 6/2000 Babuke ..... E04B 1/8209 181/290
6,112,852 A * 9/2000 D'Antonio ..... G10K 11/20 181/295
6,209,680 B1 * 4/2001 Perdue ..... E04B 1/86 181/210
6,772,859 B2 * 8/2004 D'Antonio ..... E04B 1/84 181/293
7,178,630 B1 2/2007 Perdue
7,322,441 B2 * 1/2008 D'Antonio ..... E04B 1/86 181/284
7,428,948 B2 * 9/2008 D'Antonio ..... E04B 1/86 181/292
7,520,370 B2 * 4/2009 Gudim ..... E04B 1/8209 181/284
7,604,094 B2 10/2009 Magyari
7,703,575 B2 * 4/2010 Berger, II ..... E04B 9/001 181/286
7,721,847 B2 * 5/2010 Coury ..... E04B 9/001 181/293
8,136,630 B2 3/2012 Schnitta
8,424,637 B2 * 4/2013 Lenz, Jr. ..... E04B 1/86 181/288
8,607,925 B2 12/2013 Gideonse
8,960,367 B1 * 2/2015 Leclerc ..... G10K 11/20 181/286
8,967,823 B2 * 3/2015 D'Antonio ..... F21V 21/04 362/147
9,058,799 B2 * 6/2015 Algargoosh ..... G10K 13/00
D743,091 S * 11/2015 Degrandis ..... D26/122
9,845,598 B1 * 12/2017 Hsu ..... E04B 1/99

* cited by examiner

SYSTEMS, APPARATUSES, AND METHODS FOR SOUND DIFFUSION

CROSS-REFERENCE TO RELATED APPLICATIONS

The present application claims priority to and the benefit of U.S. Provisional Patent Application No. 62/278,746, filed Jan. 14, 2016, the entire contents and disclosure of which are incorporated herein by reference.

SUMMARY

The disclosed subject matter, generally speaking, relates to acoustic or sound diffusers and systems and methods thereof. More specifically, embodiments of the disclosed subject matter can include a sound diffuser configurable in increments of 90 degree diffusive segments up to 360 degrees, which may be vertically stacked on or with one or more like configured sound diffusers. Furthermore, each of the sound diffusers may be freestanding, when arranged in one or more 90 degree diffusive segments and when vertically stacked.

According to one or more embodiments of the disclosed subject matter, a sound diffusion system can comprise a first sound diffuser; and a second sound diffuser, where each of the first and second sound diffusers includes a first flat end, a second flat end opposite the first flat end, and a diffusive surface extending radially outward from a longitudinal axis of the sound diffuser and running in a direction of the longitudinal axis from the first flat end to the second flat end, the second sound diffuser is in a stacked arrangement with the first sound diffuser, such that the first flat end of the second sound diffuser directly contacts the second flat end of the first sound diffuser, the diffusive surfaces of the first and second sound diffusers have a same diffusive pattern, the diffusive patterns of the diffusive surfaces being aligned with each other in the stacked arrangement, and each of the diffusive surfaces of the first and second sound diffusers extends in a circumferential direction relative to the longitudinal axis by at least 90 degrees, such as in increments of 90 degrees.

Additionally, in one or more embodiments a sound diffuser can comprise: a body defining a first end, a second end opposite the first end, and a diffusive surface extending radially outward from a longitudinal axis of the sound diffuser and running in a direction of the longitudinal axis from the first end to the second end, where the diffusive surface extends in a circumferential direction relative to the longitudinal axis by one of 90 degrees, 180 degrees, 270 degrees, and 360 degrees, and the first end and the second end are identical or substantially identical.

Embodiments of the disclosed subject matter can also include a method comprising: providing a first acoustic sound diffuser as described or claimed herein; and arranging the first acoustic sound diffuser. Optionally, the method can further comprise providing a second acoustic sound diffuser as described or claimed herein; and arranging the second acoustic sound diffuser relative to the first acoustic sound diffuser such that the first and second acoustic sound diffusers either contact, abut, or are adjacent to each other.

One or more embodiments of the disclosed subject matter may also include a method of making or manufacturing an acoustic sound diffuser and/or a sound diffusion system as described or claimed herein.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings.

DETAILED DESCRIPTION OF THE INVENTION

Figure 1A:
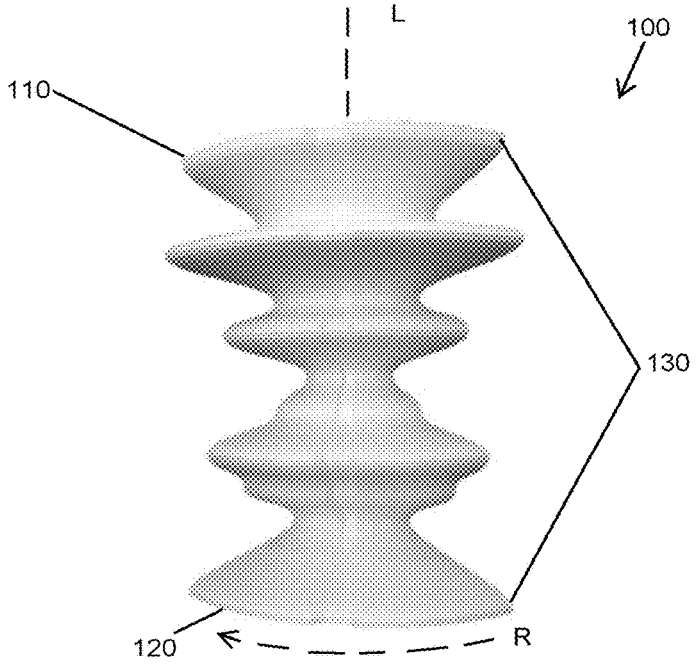
FIG. 1A is a front view of an acoustic diffuser with a 90 degree diffusive segment according to an embodiment of the disclosed subject matter.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Any reference in the specification to "one embodiment" or "an embodiment" means that a particular feature, structure, characteristic, operation, or function described in connection with an embodiment is included in one or more embodiments of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Moreover, it is intended that embodiments of the disclosed subject matter can and do cover modifications and variations of the described embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein and likewise do not necessarily limit embodiments of the disclosed subject matter to any particular configuration, orientation, or sequence.

As noted above, embodiments of the disclosed subject matter relate generally to systems, apparatuses, and methods for diffusing, scattering or spreading (spatially and/or temporally) sound or acoustic waves. More specifically, embodiments of the disclosed subject matter can include a sound diffuser configurable (or reconfigurable) in increments of 90 degree diffusive segments up to 360 degrees to provide sound diffusion by way of a 90 degree, 180 degree, 270 degree, or 360 degree diffusive surface or face. The diffusive segments, when configured horizontally in segments of two or more to provide a corresponding collective diffusive surface of one of the latter three degrees noted above, can provide a uniform, substantially uniform, or contiguous diffusive surface or face. Put another way, the diffusive segments, when horizontally arranged in groups of two or more segments, can provide diffusive surfaces having respective portions substantially equal or equal distances away from a central longitudinal or vertical axis about which each of the segments is arranged, for example, so as to have a uniform circumference, circumference portion, and/or radius relative to the central longitudinal or vertical axis of the diffusive segments.

Each diffusive surface, individually or together, can diffuse sound or acoustic waves by way of its particular diffusive configuration and/or diffusive material from which the sound diffuser or particular sound diffusive portion thereof is made. For example, embodiments of the disclosed subject matter can provide for quadratic-residue-, maximum length sequence (MLS)-, multi-dimensional-, and primitive-root-based sound/acoustic diffusion, or a combination thereof. Further, sound diffusers according to embodiments of the disclosed subject matter can be made from wood (e.g., a relatively softwood, such as cherry or pine), ceramic, hard rubber, or plastic, for instance. Sound diffusers according to embodiments of the disclosed subject matter may be solid, hollow, or a combination of solid and hollow portions.

Embodiments of the disclosed subject matter may also be or configured to be vertically stacked with one or more sound diffusers of same construction. For instance, one or more sound diffusers may be vertically stacked in alignment with each other such that the same features line up in the vertical direction and/or are otherwise oriented the same way. Further, each of the sound diffusers may be freestanding, when arranged in one or more 90 degree diffusive segments and when vertically stacked. For example, each sound diffuser can have a first end and a second end opposite the first end, where, optionally, each of the ends is flat or substantially flat to facilitate arrangement of each individual sound diffuser on a floor or support surface by way of either the first end or the second end, and corresponding individual sound diffusers vertically stacked on the other of the first end or the second end. Optionally, the first and second ends may be identical or substantially identical (e.g., slight difference(s) due to machining tolerances).

Depending upon the configuration or reconfiguration, sound diffusers according to embodiments of the disclosed subject matter can be arranged or installed to fit on or adjacent to inside corners, outside corners, or flat portions of walls. For example, a sound diffuser in the form of a 90 degree segment may be arranged to contact, abut, or be adjacent to an inside corner of a room, a sound diffuser in the form of a 180 degree effective diffusive surface (e.g., two 90 degree segments) may be arranged to contact, abut, or be adjacent to a flat portion of a wall, and a sound diffuser in the form of a 270 degree effective diffusive surface (e.g., three 90 degree segments) may be arranged to contact, abut, or be adjacent to an outside corner. Additionally or optionally, a non-diffusive surface or non-diffusive surfaces may be fixed to a portion of a wall, with one of the first end or the second end touching or being adjacent to the floor or support surface or with both of the first and second ends being above or offset from the floor or support surface.

Figure 1B:
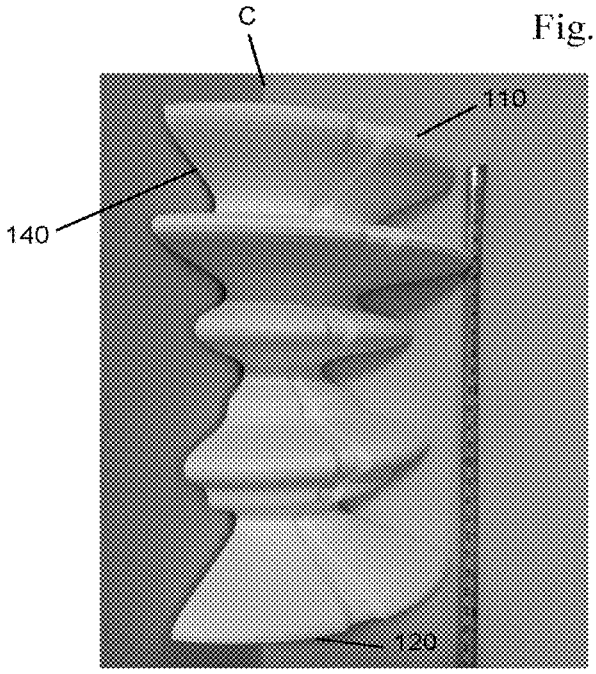
FIG. 1B is a left front perspective view of the acoustic diffuser of FIG. 1A, arranged at an inside corner.
Figure 1C:
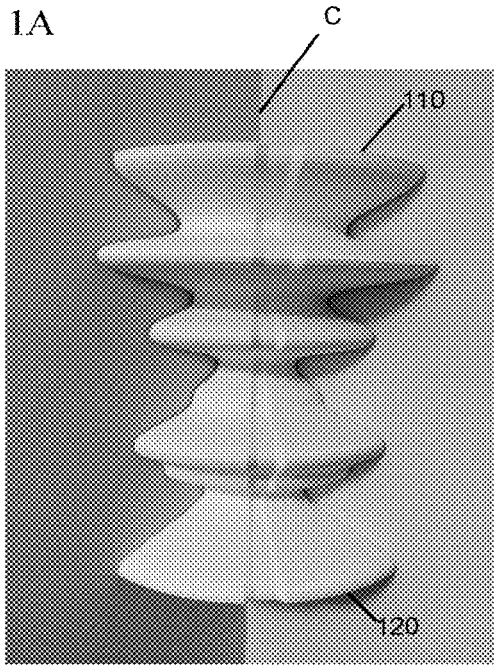
FIG. 1C is a front perspective view of the acoustic diffuser of FIG. 1B arranged at an inside corner.
Figure 1D:
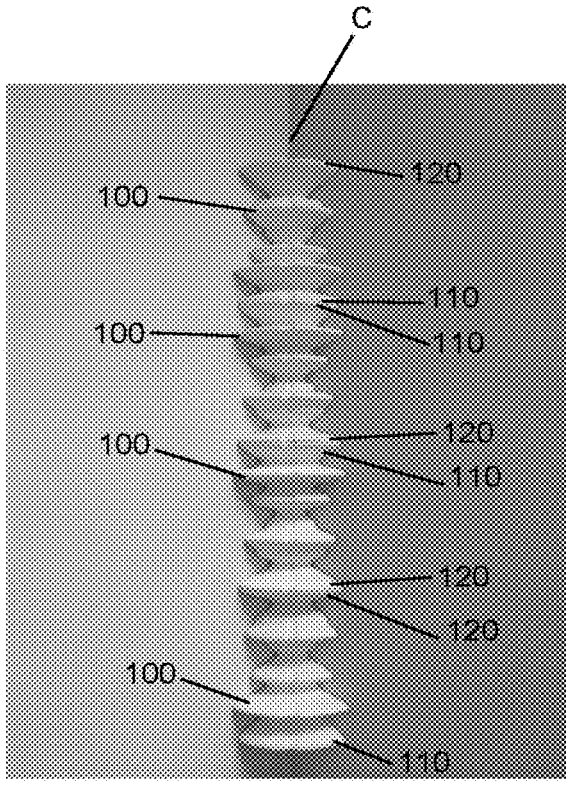
FIG. 1D is a front perspective view of a plurality of acoustic diffusers according to FIG. 1B in a vertical stack arrangement at an inside corner, above a floor surface.
Figure 1E:
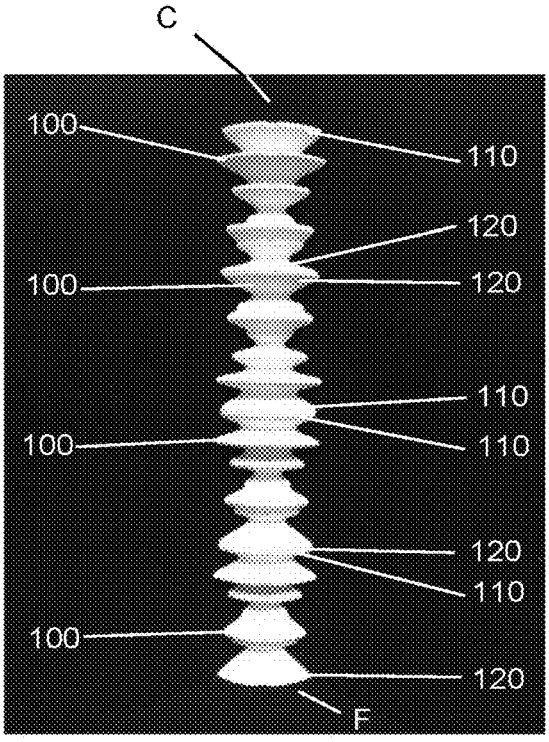
FIG. 1E is a front perspective view of a plurality of acoustic diffusers according to FIG. 1A in a vertical stack arrangement at an inside corner, on a floor surface.
Figure 1F:
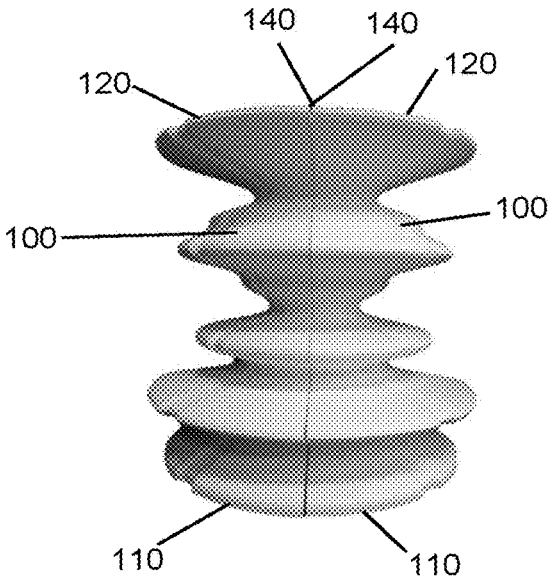
FIG. 1F is a front view of an acoustic diffuser with a 180 degree effective diffusive segment in the form of two 90 degree diffusive segments according to an embodiment of the disclosed subject matter.
Figure 1G:
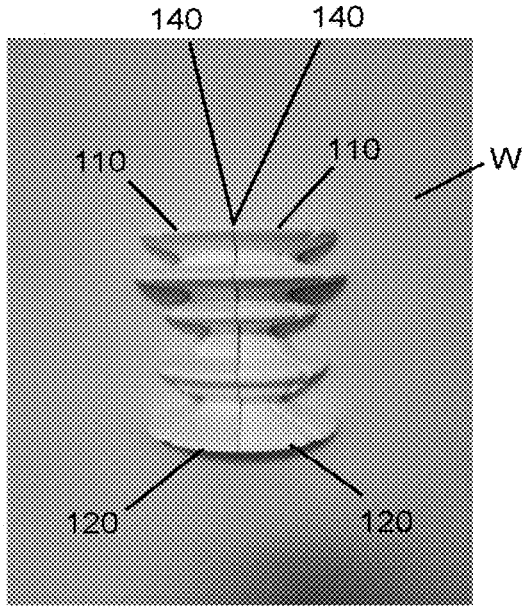
FIG. 1G is a front perspective view of the acoustic diffuser of FIG. 1F, arranged on a flat portion of a wall.
Figure 1H:
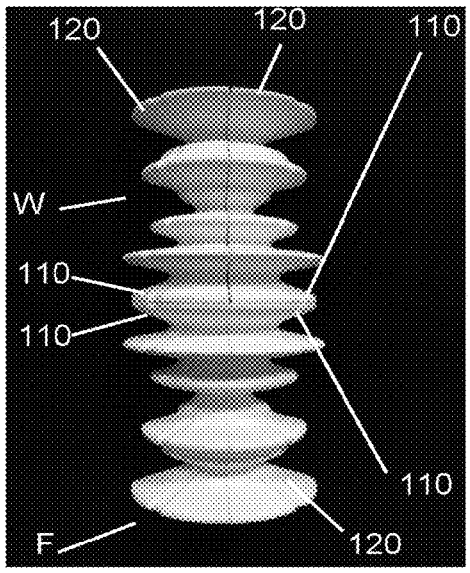
FIG. 1H is a front perspective view of a plurality of acoustic diffusers according to FIG. 1F in a vertical stack arrangement arranged on a flat portion of a wall, and on a floor surface.
Figure 1I:
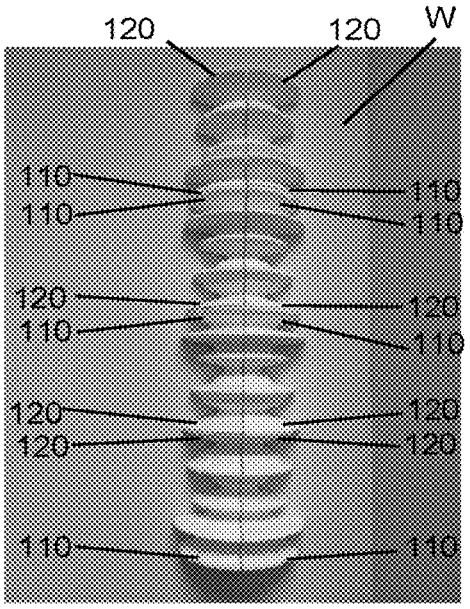
FIG. 1I is a front perspective view of a plurality of acoustic diffusers according to FIG. 1G in a vertical stack arrangement on a flat portion of a wall, above a floor surface.
Figure 1J:
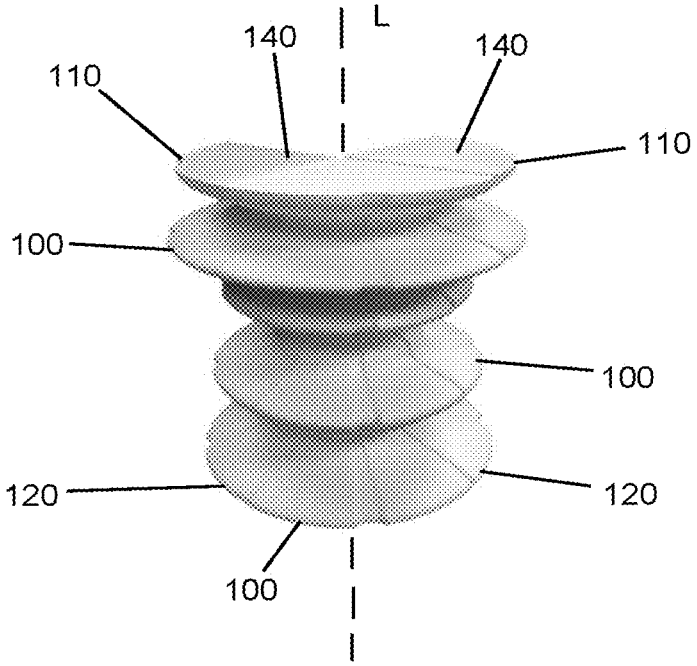
FIG. 1J is a front overhead perspective view of an acoustic diffuser with a 270 degree effective diffusive segment in the form of three 90 degree diffusive segments according to an embodiment of the disclosed subject matter.
Figure 1K:
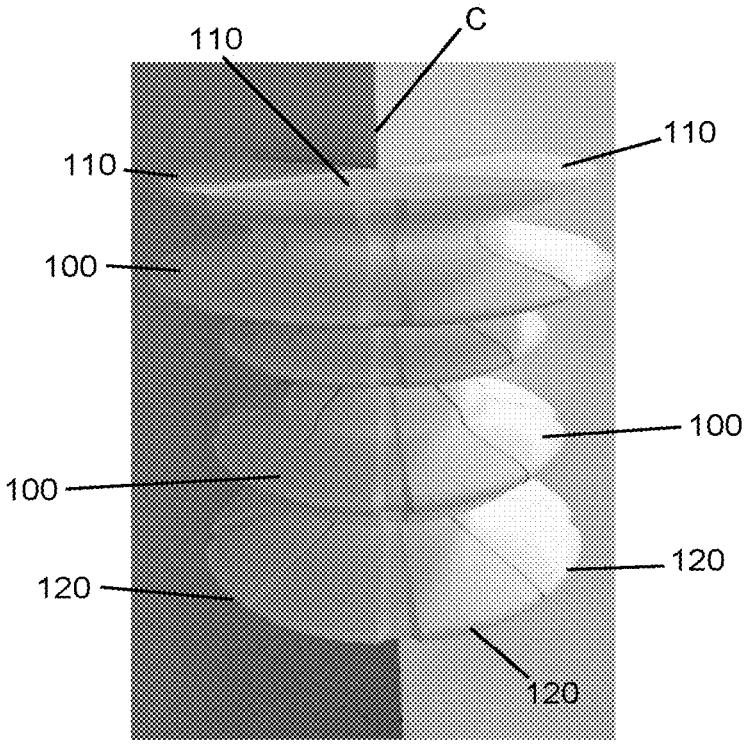
FIG. 1K is a front overhead perspective view of the acoustic diffuser of FIG. 1J, arranged at an outside corner.
Figure 1L:
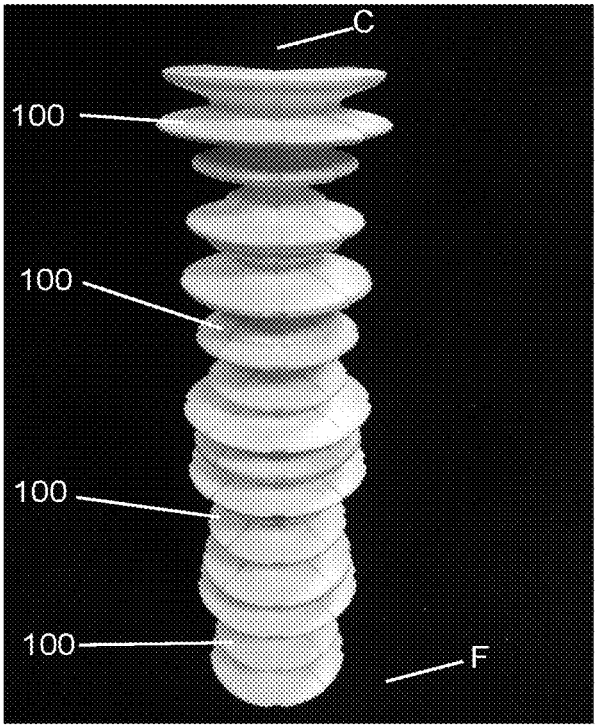
FIG. 1L is a front overhead perspective view of a plurality of acoustic diffusers according to FIG. 1J in a vertical stack arrangement at an outside corner, on a floor surface.
Figure 1M:
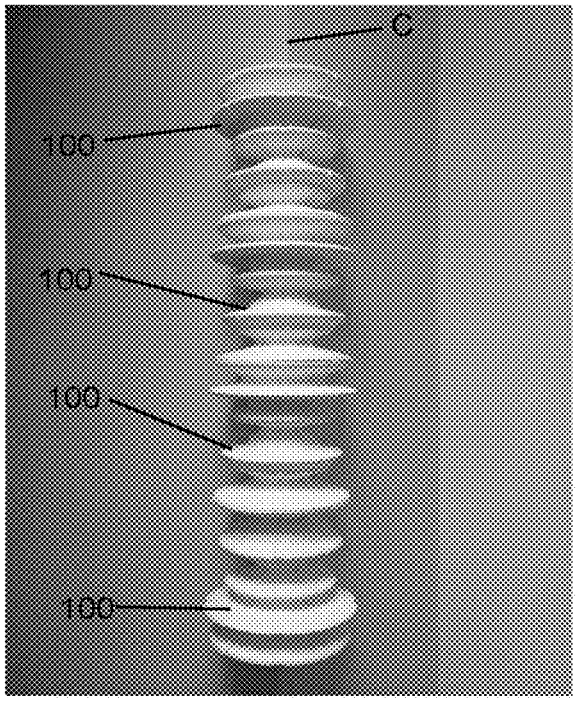
FIG. 1M is a front view of a plurality of acoustic diffusers according to FIG. 1K in a vertical stack arrangement at an outside corner, above a floor surface.
Figure 1N:
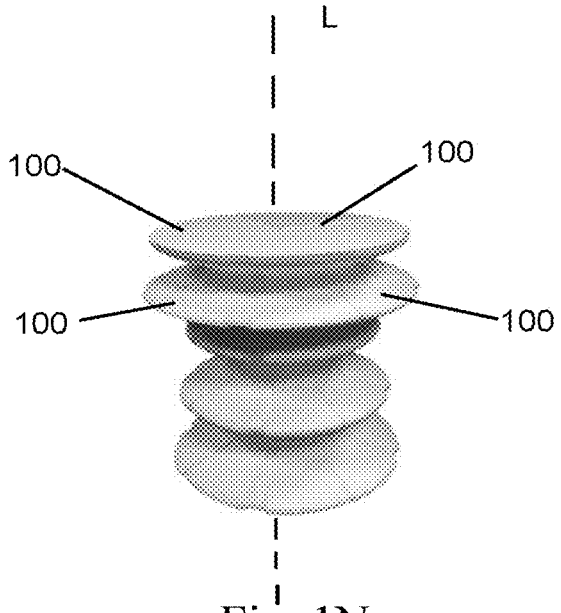
FIG. 1N is a front overhead perspective view of an acoustic diffuser with a 360 degree effective diffusive segment in the form of four 90 degree diffusive segments according to an embodiment of the disclosed subject matter.
Figure 1O:
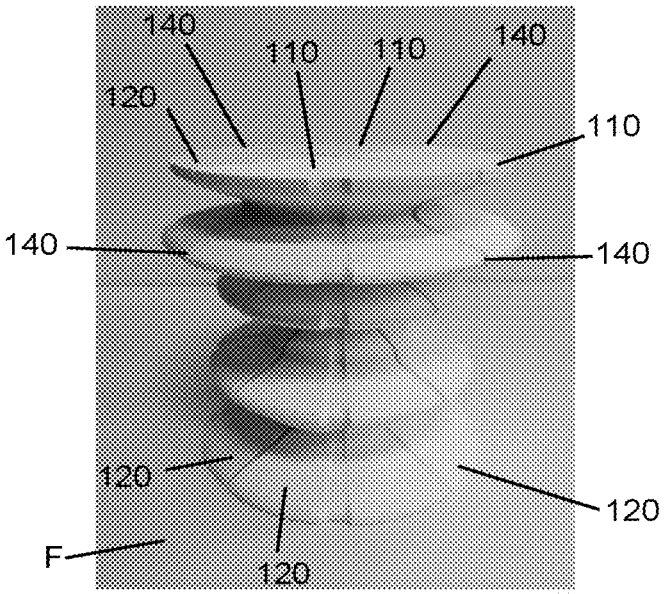
FIG. 1O is a front overhead perspective view of the acoustic diffuser of FIG. 1N, arranged on a floor surface.
Figure 1P:
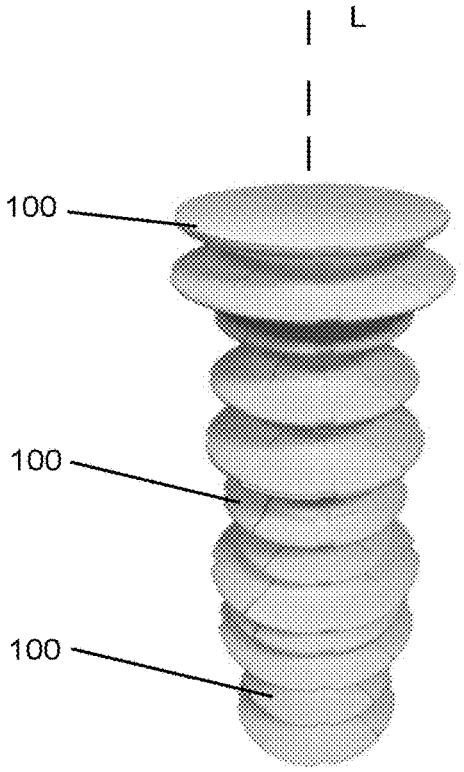
FIG. 1P is a front overhead perspective view of a plurality of acoustic diffusers according to FIG. 1N in a vertical stack arrangement.
Figure 1Q:
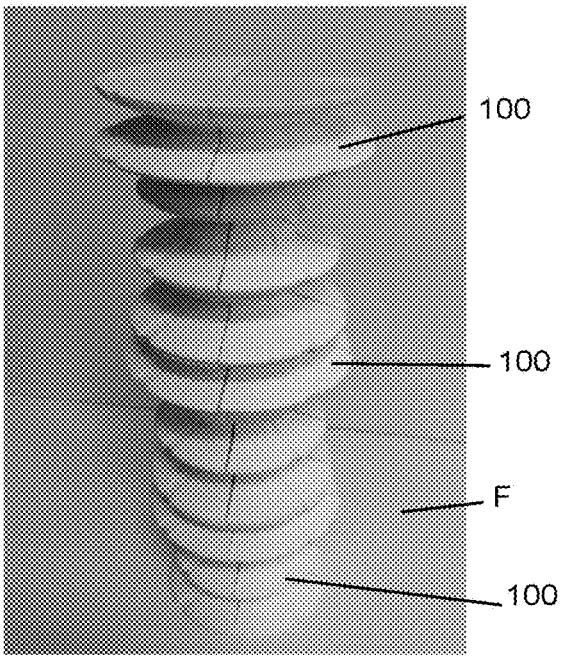
FIG. 1Q is a left front overhead perspective view of a plurality of acoustic diffusers according to FIG. 1O in a vertical stack arrangement, on a floor surface.
Figure 2A:
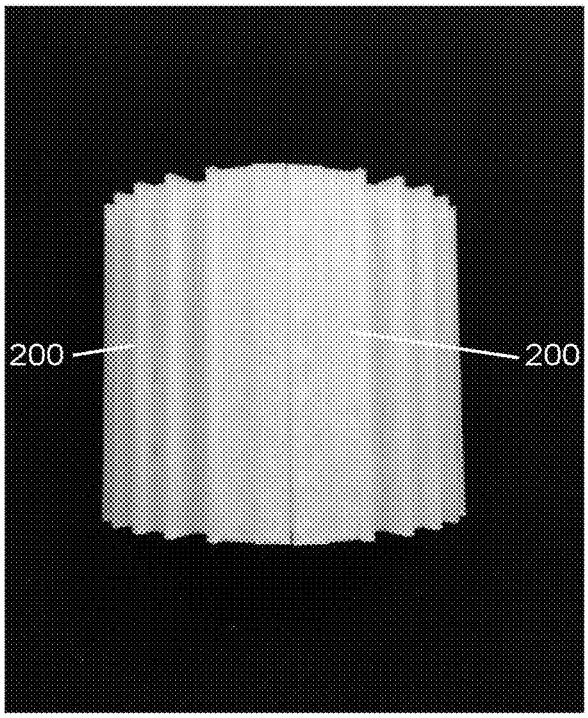
FIG. 2A is a front view of an acoustic diffuser with a 180 degree effective diffusive segment in the form of two 90 degree diffusive segments according to another embodiment of the disclosed subject matter.
Figure 2B:
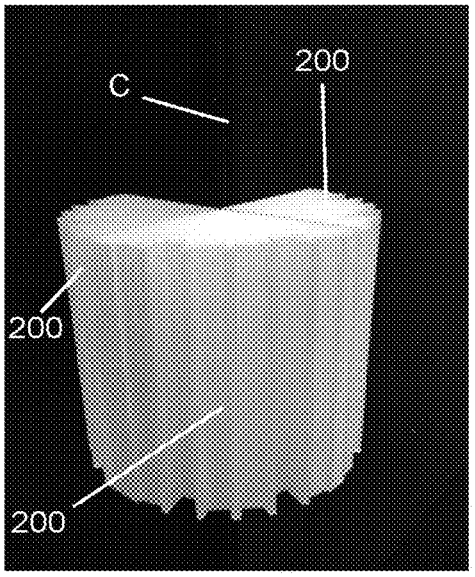
FIG. 2B is a front overhead perspective view of an acoustic diffuser with a 270 degree effective diffusive segment in the form of three 90 degree diffusive segments, at an outside corner, above a floor surface.
Figure 2C:
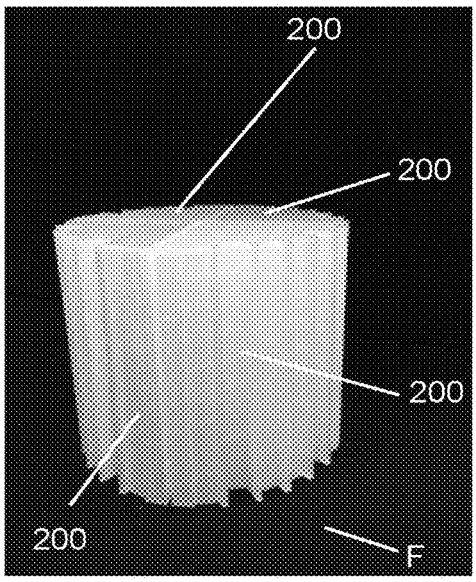
FIG. 2C is a front overhead perspective view of an acoustic diffuser with a 360 degree effective diffusive segment in the form of four 90 degree diffusive segments, on a floor surface.
Figure 2D:
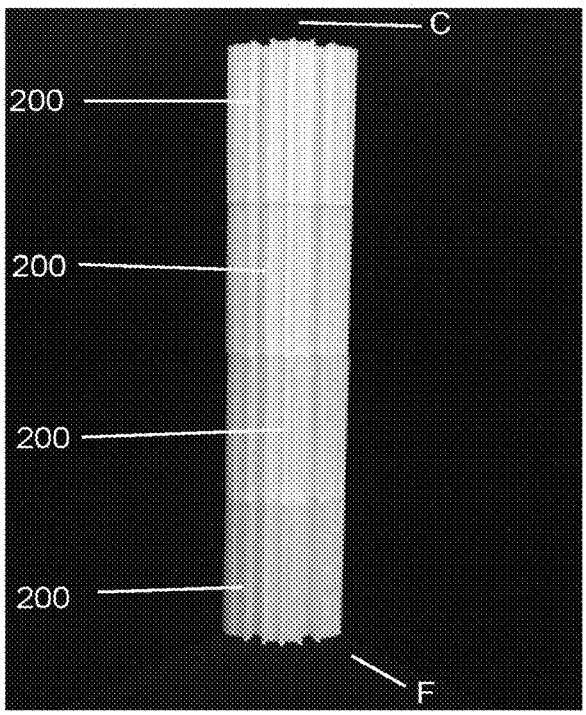
FIG. 2D is a front view of a plurality of acoustic diffusers with a 90 degree diffusive segment arranged at an inside corner, in a vertical stacked configuration, and on a floor surface.
Figure 2E:
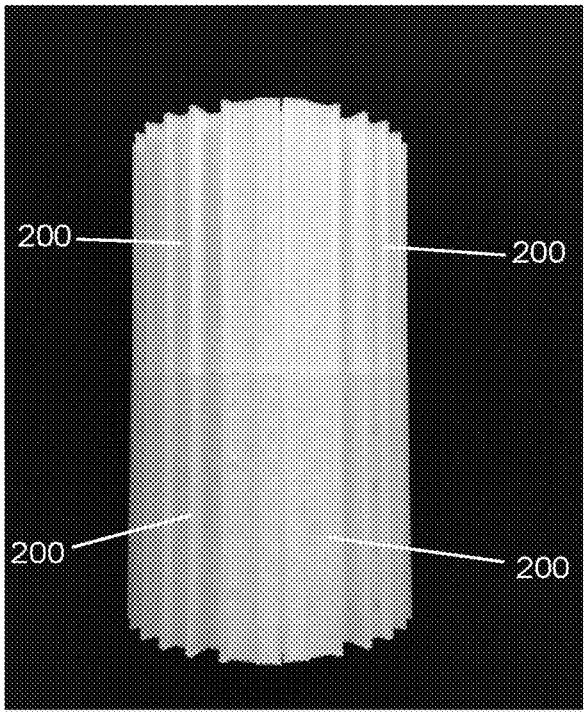
FIG. 2E is front view of a plurality of acoustic diffusers according to FIG. 2A in a vertical stack arrangement.
Figure 3A:
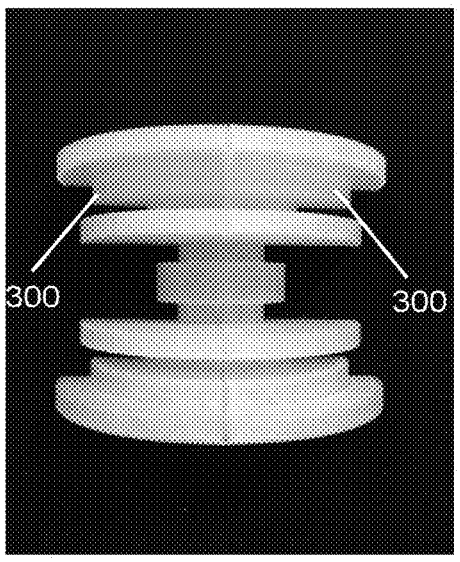
FIG. 3A is a front view of an acoustic diffuser with a 180 degree effective diffusive segment in the form of two 90 degree diffusive segments according to another embodiment of the disclosed subject matter.
Figure 3B:
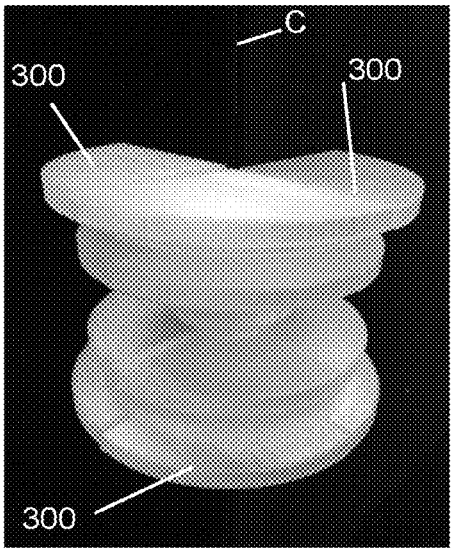
FIG. 3B is a front overhead perspective view of an acoustic diffuser with a 270 degree effective diffusive segment in the form of three 90 degree diffusive segments, arranged at an outside corner, above a floor surface.
Figure 3C:
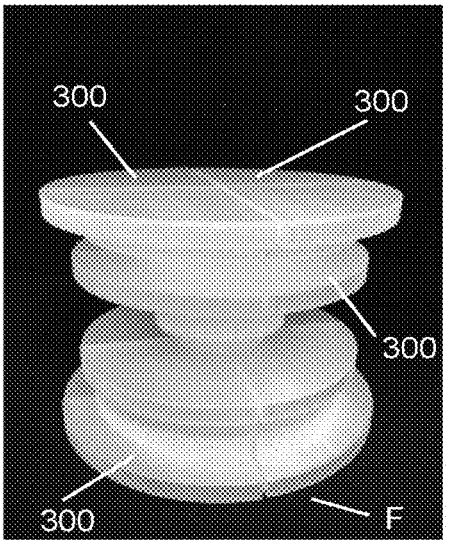
FIG. 3C is a front overhead perspective view of an acoustic diffuser with a 360 degree effective diffusive segment in the form of four 90 degree diffusive segments, arranged on a floor surface.
Figure 3D:
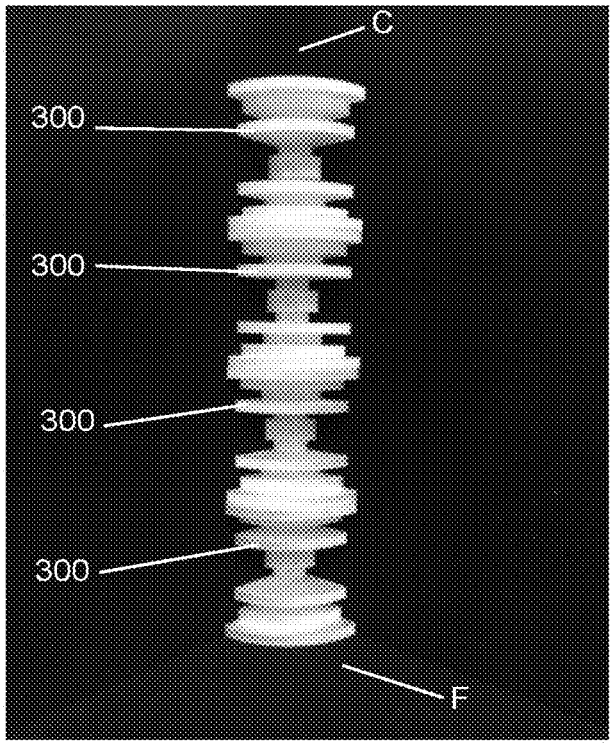
FIG. 3D is a front perspective view of a plurality of acoustic diffusers with a 90 degree diffusive segment arranged at an inside corner, in a vertical stacked configuration, on a floor surface.
Figure 3E:
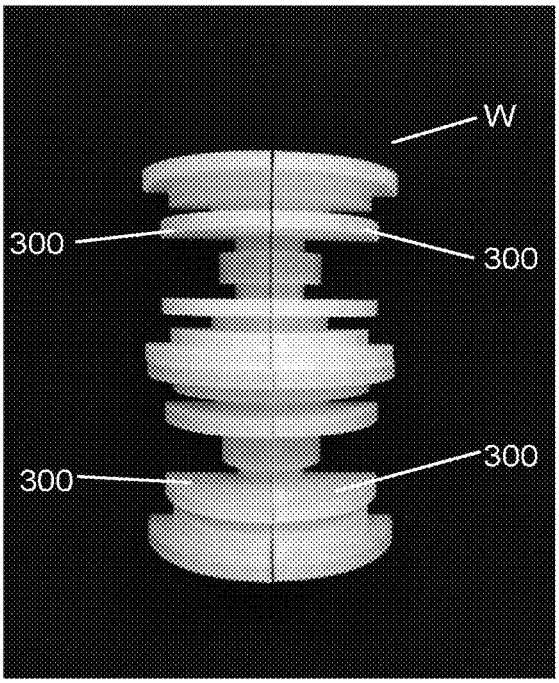
FIG. 3E is front view of a plurality of acoustic diffusers according to FIG. 3A in a vertical stack arrangement, provided against a wall.
Figure 4A:
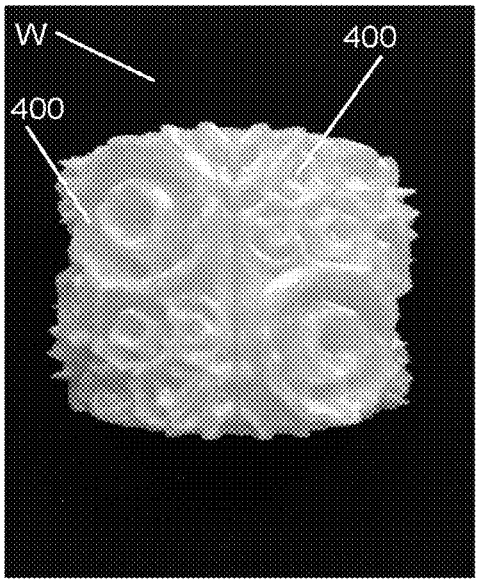
FIG. 4A is a front view of an acoustic diffuser with a 180 degree effective diffusive segment in the form of two 90 degree diffusive segments according to another embodiment of the disclosed subject matter.
Figure 4B:
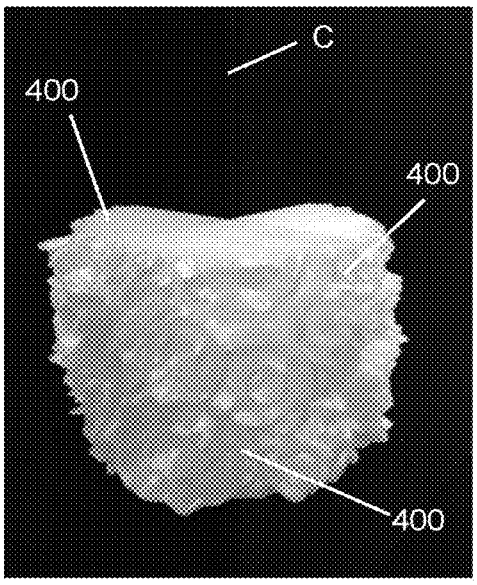
FIG. 4B is a front overhead perspective view of an acoustic diffuser with a 270 degree effective diffusive segment in the form of three 90 degree diffusive segments, arranged at an outside corner, above a floor surface.
Figure 4C:
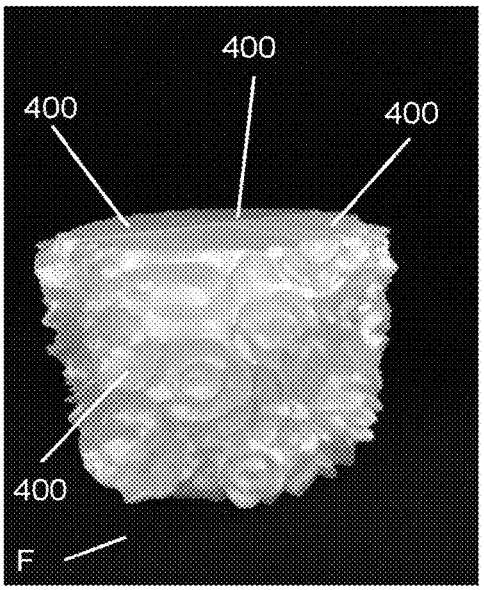
FIG. 4C is a front overhead perspective view of an acoustic diffuser with a 360 degree effective diffusive segment in the form of four 90 degree diffusive segments, arranged on a floor surface.
Figure 4D:
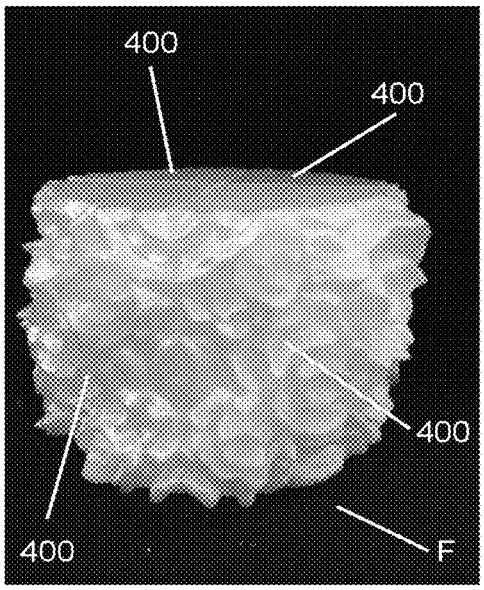
FIG. 4D is a left front overhead perspective view of the acoustic diffuser of FIG. 4C.
Figure 4E:
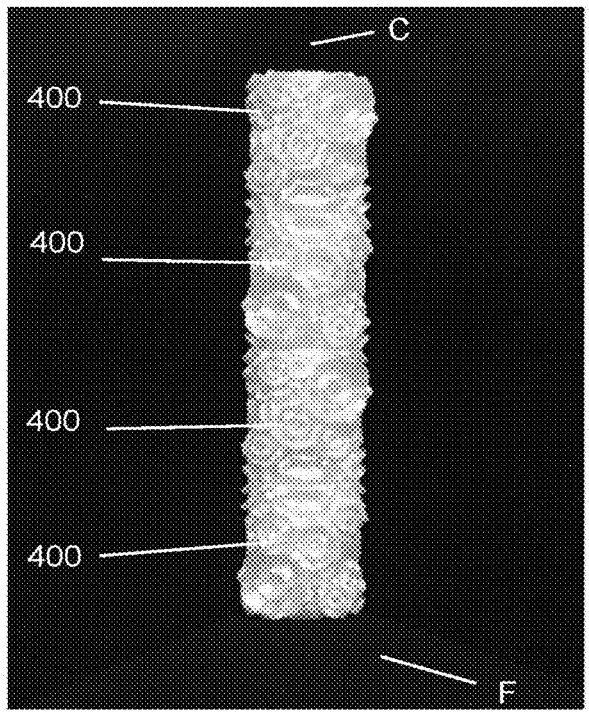
FIG. 4E is a front perspective view of a plurality of acoustic diffusers with a 90 degree diffusive segment arranged at an inside corner, in a vertical stacked configuration, on a floor surface.
Figure 4F:
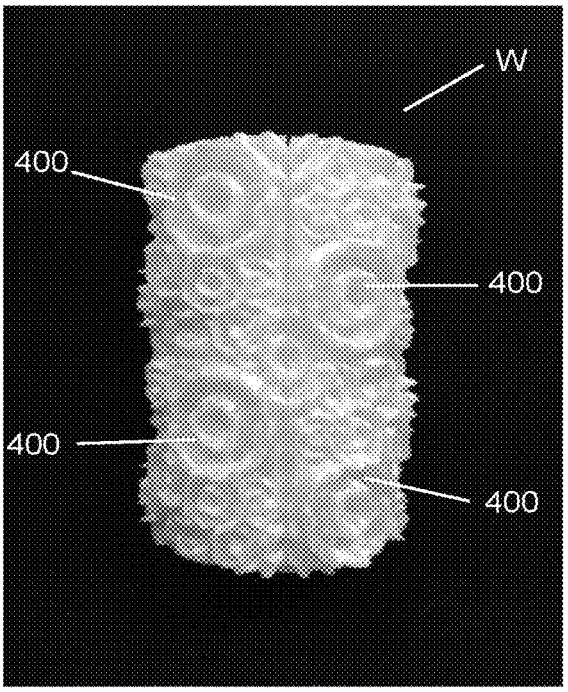
FIG. 4F is front view of a plurality of acoustic diffusers according to FIG. 4A in a vertical stack arrangement.
Figure 5A:
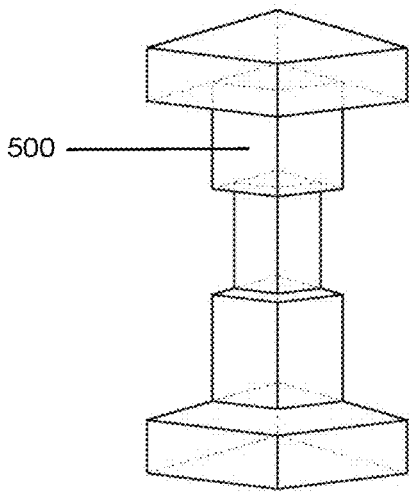
FIG. 5A is a diagrammatic front overhead perspective view of an acoustic diffuser with a 90 degree diffusive segment according to an embodiment of the disclosed subject matter.
Figure 5B:
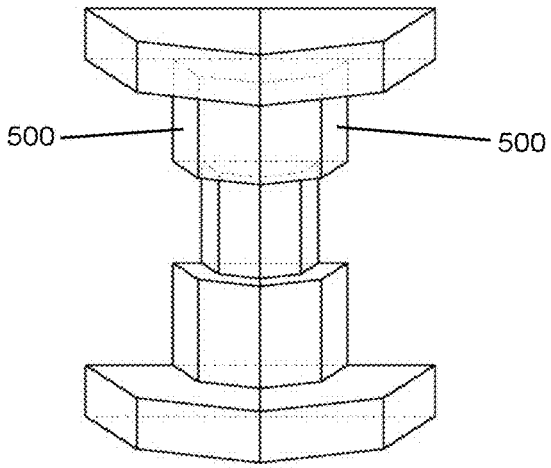
FIG. 5B is a diagrammatic front overhead perspective view of an acoustic diffuser with a 180 degree effective diffusive segment in the form of two 90 degree diffusive segments according to the embodiment of FIG. 5A.
Figure 5C:
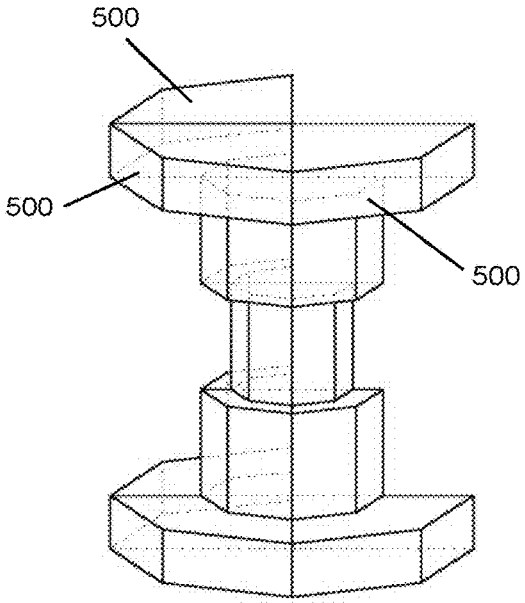
FIG. 5C is a diagrammatic front overhead perspective view an acoustic diffuser with a 270 degree effective diffusive segment in the form of three 90 degree diffusive segments according to the embodiment of FIG. 5A.
Figure 5D:
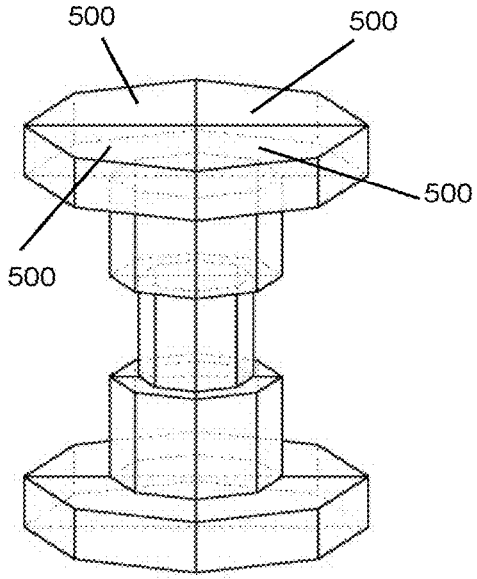
FIG. 5D is a diagrammatic front overhead perspective view an acoustic diffuser with a 360 degree effective diffusive segment in the form of four 90 degree diffusive segments according to the embodiment of FIG. 5A.
Figure 6A:
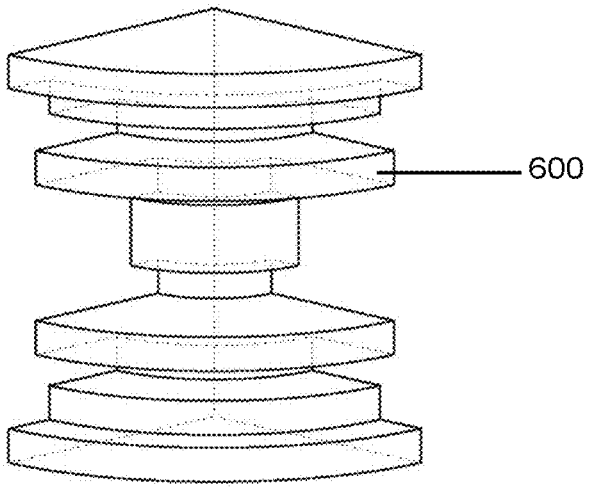
FIG. 6A is a transparent diagrammatic front overhead perspective view of an acoustic diffuser with a 90 degree diffusive segment according to yet another embodiment of the disclosed subject matter.
Figure 6B:
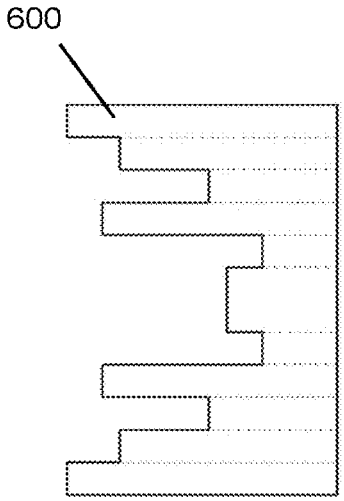
FIG. 6B is a transparent back view of the acoustic diffuser of FIG. 6A.
Figure 6C:
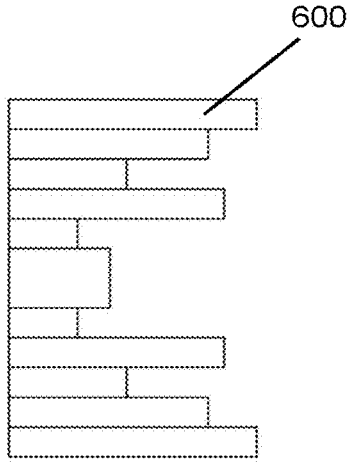
FIG. 6C is a front view of the acoustic diffuser of FIG. 6A.
Figure 6D:
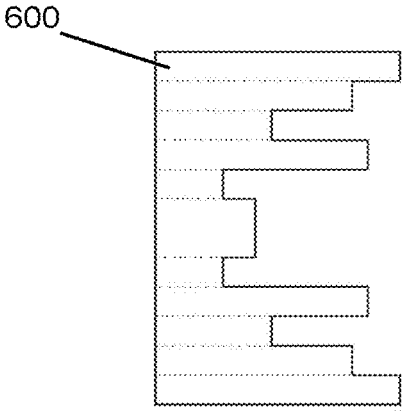
FIG. 6D is a transparent left side view of the acoustic diffuser of FIG. 6A.
Figure 6E:
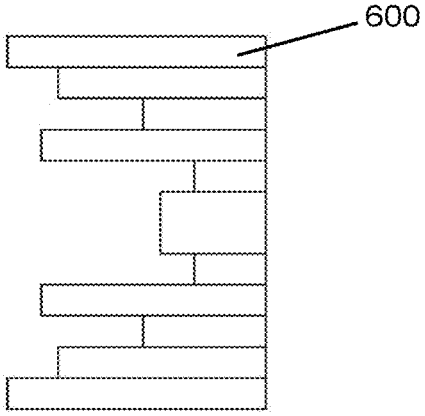
FIG. 6E is a right side view of the acoustic diffuser of FIG. 6A.
Figure 6F:
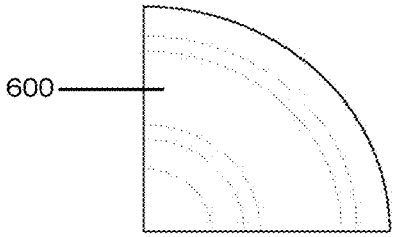
FIG. 6F is a transparent bottom view of the acoustic diffuser of FIG. 6A.
Figure 6G:
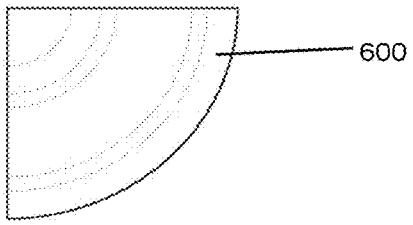
FIG. 6G is a transparent top view of the acoustic diffuser of FIG. 6A.
Figure 6H:
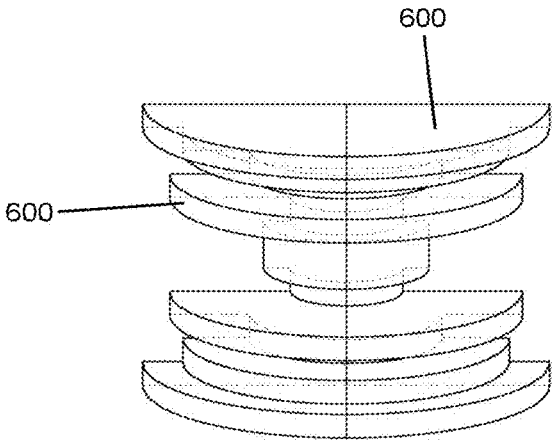
FIG. 6H is a transparent front overhead perspective view of an acoustic diffuser with a 180 degree effective diffusive segment in the form of two 90 degree diffusive segments according to the embodiment of FIG. 6A.
Figure 6I:
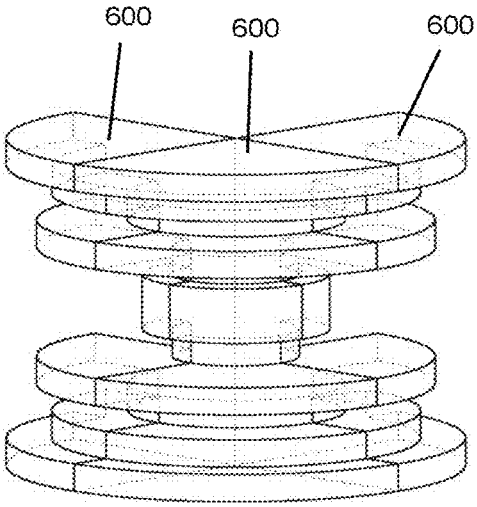
FIG. 6I is a transparent front overhead perspective view of an acoustic diffuser with a 270 degree effective diffusive segment in the form of three 90 degree diffusive segments according to the embodiment of FIG. 6A.
Figure 7A:
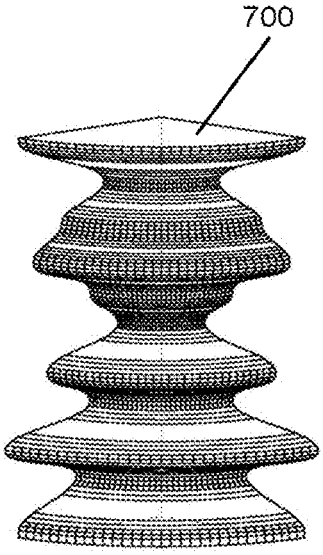
FIG. 7A is an isometric front overhead perspective view of an acoustic diffuser with a 90 degree diffusive segment according to another embodiment of the disclosed subject matter.
Figure 7B:
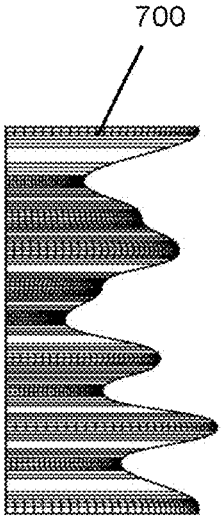
FIG. 7B is a front view of the acoustic diffuser of FIG. 7A.
Figure 7C:
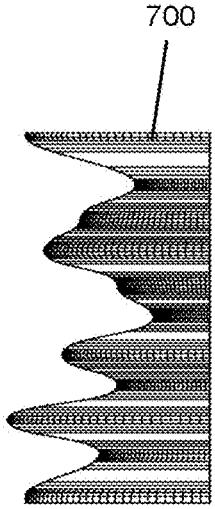
FIG. 7C is a right view of the acoustic diffuser of FIG. 7A.
Figure 7D:
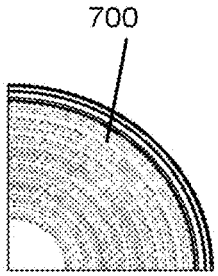
FIG. 7D is a transparent bottom view of the acoustic diffuser of FIG. 7A.
Figure 7E:
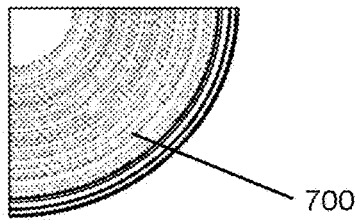
FIG. 7E is a transparent top view of the acoustic diffuser of FIG. 7A.
Figure 7F:
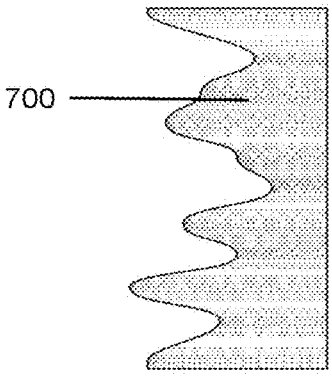
FIG. 7F is a back view of the acoustic diffuser of FIG. 7A.
Figure 7G:
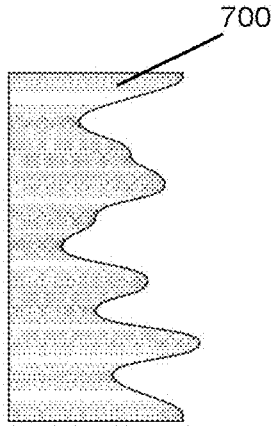
FIG. 7G is a left view of the acoustic diffuser of FIG. 7A.
Figure 7H:
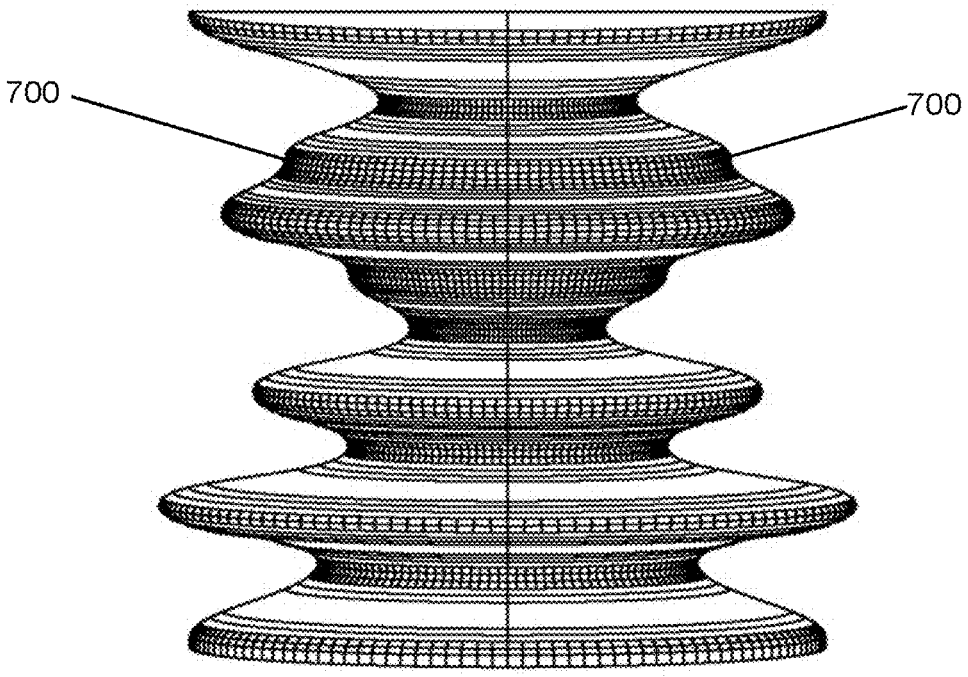
FIG. 7H is an isometric front view of an acoustic diffuser with a 180 degree effective diffusive segment in the form of two 90 degree diffusive segments according to the embodiment of FIG. 7A.

Turning now to the figures, and discussing first FIGS. 1A-1Q, generally speaking, FIG. 1A is a front perspective view of an acoustic diffuser 100 with a 90 degree diffusive surface or face according to an embodiment of the disclosed subject matter. The acoustic diffuser 100 can have a body defining a first end 110, a second end 120 opposite the first end, and a diffusive surface extending radially outward from a longitudinal or vertical axis of the acoustic diffuser and running in a direction of the longitudinal or vertical axis L from the first end 110 to the second end 120. As illustrated in FIG. 1A, for instance, the diffusive surface 130 can extend in a circumferential direction R relative to the longitudinal or vertical axis L by 90 degrees. FIGS. 1B and 1C illustrate the acoustic diffuser 100 arranged in an inside corner C formed at a vertex of two walls, such that a back wall 140 defined by the body of the acoustic diffuser 100 contacts, abuts, or is adjacent to the two walls. Additionally, the acoustic diffuser 100 may be fixed to the inside corner C such that the second end 120 is spaced from a floor or support surface. Of course, as will be discussed in more detail below, either first end 110 or second end 120 may rest on the floor or support surface.

The diffusive surface 130 can undulate from the first end 110 to the second end 120, such as illustrated in illustrated in FIGS. 1A-1C or according to another undulating pattern. Further, though the undulating pattern in FIGS. 1A-1C is continuous, one or more embodiments of the disclosed subject matter can have distinct undulating portions, for instance, separated by a flat and/or non-undulating portion. The diffusive surface 130 of FIGS. 1A-1C can provide for an asymmetric spline quadratic curvature along the longitudinal axis, whose profile can create longitudinal diffusion compounded with the axial rotational extrusion of the profile, and whose curvature can add additional diffusion radially.

FIGS. 1D and 1E illustrate a plurality of acoustic diffuser 100 arranged in a vertical stack, at an inside corner C, where FIG. 1D shows the vertical stack fixed at the inside corner C above a floor, and where FIG. 1E shows the vertical stack fixed at the inside corner C, but resting on floor F. In FIG. 1D, a bottom-most acoustic diffuser can be fixed to the wall via adhesive or one or more mechanical connections, whereas some or all of the acoustic diffusers above the bottom-most acoustic diffuser may be freestanding on the bottom-most diffuser, or may likewise be fixed to the wall via adhesive or one or more mechanical connections. Furthermore, the ends of adjacent acoustic diffusers can be in direct contact with each other, such that each acoustic diffuser freely rests on a subjacent acoustic diffuser. Optionally, each of the first end 110 and the second end 120 is flat. Alternatively, ends of adjacent acoustic diffusers can be fixed together, for instance, via an adhesive or a coupling member formed in the acoustic diffusers.

Additionally, a first end 110 of a subjacent acoustic diffuser may have vertically stacked thereon either a first end 110 or a second end 120 of the acoustic diffuser directly thereabove. Likewise, a second end 120 of a subjacent acoustic diffuser may have vertically stacked thereon either a first end 110 or a second end 120 of the acoustic diffuser directly thereabove. Thus, the acoustic diffusers can be aligned in the vertical direction, for example, such that the canyon of the embodiment of FIGS. 1A-1C is aligned, diffusive patterns may repeat or be reversed from acoustic diffuser to acoustic diffuser.

FIG. 1F is a front perspective view of an acoustic diffuser with a 180 degree effective diffusive surface or face according to one or more embodiments of the disclosed subject matter. Though FIG. 1F shows the acoustic diffuser being comprised of two aligned acoustic diffusers 100 of FIG. 1A, alternatively, the acoustic diffuser of FIG. 1F can be of unitary or one-piece construction. In this regard, it is noted that the diffusers 100 can be aligned so as to provide a uniform face or surface in each horizontal plane from the first end 110 to the second end 120.

FIG. 1G illustrates the acoustic diffuser of FIG. 1F arranged on a wall W, such that a contiguous portion formed by two portions of back walls 140 is flush with the wall W. FIG. 1G also illustrates the acoustic diffuser fixed to an upper portion of wall W, above a floor or support surface. Of course, the acoustic diffuser of FIGS. 1F and 1G can be arranged to stand freely on the floor or support surface by way of the first ends 110 or the second ends 120.

Turning back to FIG. 1F, portions of back walls 140 for the 90 degree acoustic diffusers 100 of FIG. 1A can be arranged in contact with or adjacent to each other. The interface between the two portions of the back walls 140 may be imperceptible, substantially imperceptible, or a slight gap or space may exist. For example, the two portions of the back walls 140 can be flat. Additionally, the two portions of the back walls 140 may be freestanding with respect to each other, or, alternatively, coupled together, for instance, via an adhesive or coupling mechanism built into the respective two portions of the back walls 140, or via one or more bands or ties wrapped around the diffusers 100.

FIGS. 1H and 1I illustrate a plurality of acoustic diffusers of FIGS. 1F and 1G arranged in a vertical stack, where FIG. 1I shows the vertical stack fixed to a wall W above a floor, and where FIG. 1H shows the vertical stack resting on floor F. In FIG. 1I, a bottom-most acoustic diffuser can be fixed to the wall via adhesive or one or more mechanical connections, whereas some or all of the acoustic diffusers above the bottom-most acoustic diffuser may be freestanding on the bottom-most diffuser, or may likewise be fixed to the wall via adhesive or one or more mechanical connections. Furthermore, the ends of adjacent acoustic diffusers can be in direct contact with each other, such that each acoustic diffuser freely rests on a subjacent acoustic diffuser. Optionally, each of the first end 110 and the second end 120 is flat. Alternatively, ends of adjacent acoustic diffusers can be fixed together, for instance, via an adhesive or a coupling member formed in the acoustic diffusers.

FIG. 1J is a front overhead perspective view of an acoustic diffuser with a 270 degree effective diffusive surface or face according to one or more embodiments of the disclosed subject matter. Though FIG. 1J shows the acoustic diffuser being comprised of three aligned acoustic diffusers 100 of FIG. 1A, alternatively, the acoustic diffuser of FIG. 1J can be of unitary or one-piece construction. In this regard, it is noted that the diffusers 100 can be aligned so as to provide a uniform face or surface in each horizontal plane from the first end 110 to the second end 120.

FIG. 1K illustrates the acoustic diffuser of FIG. 1J arranged on an outside corner C, such that a contiguous portion formed by respective portions of back walls 140 for the three segments is flush with the wall W. FIG. 1K also illustrates the acoustic diffuser fixed to an upper portion of the outside corner C, above a floor or support surface. Of course, the acoustic diffuser of FIGS. 1J and 1K can be arranged to stand freely on the floor or support surface by way of the first ends 110 or the second ends 120.

Turning back to FIG. 1J, portions of back walls 140 for the 90 degree acoustic diffusers 100 of FIG. 1A can be arranged in contact with or adjacent to each other. The interface between the two portions of the back walls 140 between adjacent diffusers 100 may be imperceptible, substantially imperceptible, or a slight gap or space may exist. For example, the two portions of the back walls 140 between adjacent diffusers 100 can be flat. Additionally, the two portions of the back walls 140 between adjacent diffusers 100 may be freestanding with respect to each other, or, alternatively, coupled together, for instance, via an adhesive or coupling mechanism built into each portion of the back walls 140.

FIGS. 1L and 1M illustrate a plurality of acoustic diffusers of FIGS. 1J and 1K arranged in a vertical stack, where FIG. 1M shows the vertical stack at an outside corner C above a floor, and where FIG. 1L shows the vertical stack resting on floor F, also at an outside corner C. In FIG. 1M, a bottom-most acoustic diffuser can be fixed to outside corner C via adhesive or one or more mechanical connections, whereas some or all of the acoustic diffusers above the bottom-most acoustic diffuser may be freestanding on the bottom-most diffuser, or may likewise be fixed to the wall via adhesive or one or more mechanical connections. Furthermore, the ends of adjacent acoustic diffusers can be in direct contact with each other, such that each acoustic diffuser freely rests on a subjacent acoustic diffuser. Optionally, each of the first end 110 and the second end 120 is flat. Alternatively, ends of adjacent acoustic diffusers can be fixed together, for instance, via an adhesive or a coupling member formed in the acoustic diffusers.

FIG. 1N is a front overhead perspective view of an acoustic diffuser with a 360 degree effective diffusive surface or face according to one or more embodiments of the disclosed subject matter. Though FIG. 1N shows the acoustic diffuser being comprised of four aligned acoustic diffusers 100 of FIG. 1A, alternatively, the acoustic diffuser of FIG. 1N can be of unitary or one-piece construction. In this regard, it is noted that the acoustic diffusers 100 can be aligned to provide a uniform face or surface in each horizontal plane from the first end 110 to the second end 120.

FIG. 1O illustrates the acoustic diffuser of FIG. 1N arranged on a floor F, for instance, in freestanding fashion. Of course, alternatively, the acoustic diffuser of FIGS. 1N and 1O can be fixed to the floor F at one of the first end 110 and second end 120 and/or the four acoustic diffusers 100 can be coupled together and respective portions of back wall 140.

Turning back to FIG. 1N, portions of back walls 140 for the 90 degree acoustic diffusers 100 of FIG. 1A can be arranged in contact with or adjacent to each other. The interface between the two portions of the back walls 140 between adjacent diffusers 100 may be imperceptible, substantially imperceptible, or a slight gap or space may exist. For example, the two portions of the back walls 140 between adjacent diffusers 100 can be flat. Additionally, the two portions of the back walls 140 between adjacent diffusers 100 may be freestanding with respect to each other, or, alternatively, coupled together, as noted above, for instance, via an adhesive or coupling mechanism built into each portion of the back walls 140.

FIGS. 1P and 1Q illustrate a plurality of acoustic diffusers of FIGS. 1N and 1O arranged in a vertical stack, where FIG. 1Q shows the vertical stack provided on a floor F. As noted above, the acoustic diffusers may be freestanding on the floor F, meaning that they are not physically coupled to the floor F and/or the individual segments (e.g., in units of 90 degrees or 180 degrees) are not coupled together at their back walls 140. Freestanding may also indicate that the non-bottom acoustic diffusers are not fixed to either each other or the bottom-most acoustic diffuser. As yet another option, one group of diffusers may be fixed together, but not with one or more adjacent acoustic diffusers. Alternatively, the entire stack may be fixed together at the first end 110 and the second end 120 and/or the individual and/or the four acoustic diffusers 100 can be coupled together and respective portions of back walls 140.

FIGS. 2A-2E, 3A-3E, 4A-4F, 5A-5D, 6A-6I, and 7A-7H illustrate non-limiting examples of acoustic diffusers according to embodiments of the disclosed subject matter, each of which providing a different diffusive effect according to the particular diffusive surface or surface portions provided therein.

For example, the diffuser(s) 200 of FIGS. 2A-2E can provide a limited longitudinal diffusion with complex radial diffusion, due to the compound curvature and single dimensional quadratic stepped profile extruded longitudinally, which can provide a tunable stepped curvature radially, with limited modification to the vertical specularity, the diffuser(s) 300 of FIGS. 3A-3E can provide a symmetric stepped quadratic profile along the longitudinal axis, whose profile can create tunable longitudinal diffusion compounded with the axial rotational extrusion of the profile, and whose curvature can add additional diffusion radially, the diffuser(s) 400 of FIGS. 4A-4F can provide an asymmetric two-dimensional organic quadratic geometry along the longitudinal face, flexed radially over the 90 degree profile, whose complex geometry can create both complex longitudinal and radial diffusion, compounded with the radial flexion of the profile, and whose curvature can add additional diffusion radially, and the diffuser(s) 500 of FIGS. 5A-5D can provide a symmetric stepped quadratic profile along the longitudinal axis, whose profile can create tunable longitudinal diffusion, with the angular axial extrusion of the profile limiting the diffusion radially. The diffuser(s) 600 of FIGS. 6A-6I, generally speaking, is an example of a technical illustration of diffuser 300 described above and illustrated in FIGS. 3A-3E. Similarly, the diffuser(s) 700 of FIGS. 7A-7H, generally speaking, is an example of a technical illustration of diffuser 100 described above and illustrated in FIGS. 1A-1Q. Of course, the embodiments of FIGS. 2A-2E, 3A-3E, 4A-4F, 5A-5D, 6A-6I, and 7A-7H can be configured (and re-configured) and/or arranged based on the discussion set forth above for FIGS. 1A-1Q.

Figure 8:
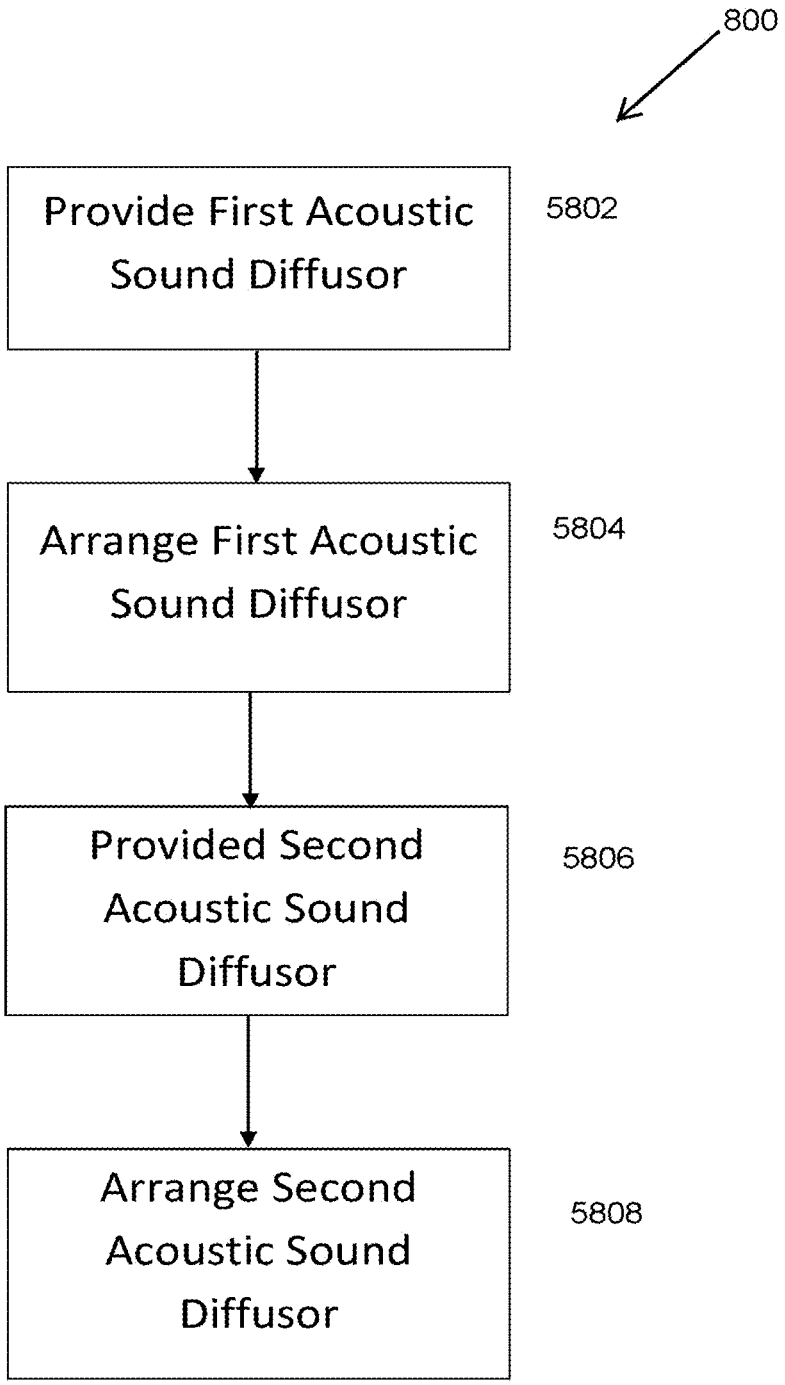
FIG. 8 is a flow chart of a method according to one or more embodiments of the disclosed subject matter.

FIG. 8 is a flow chart of a method 800 according to one or more embodiments of the disclosed subject matter.

Method 800 can comprise providing a first acoustic sound diffuser S802, such as described or claimed herein or as illustrated in the figures, and optionally arranging the first acoustic diffuser S804, for instance, relative to a wall or support surface and/or a portion of a wall, such as described or claimed herein or as illustrated in the figures. Optionally, method 800 can further comprise providing a second acoustic sound diffuser S806, such as described or claimed herein or as illustrated in the figures, and arranging the second acoustic diffuser S808 relative to the first acoustic sound diffuser, such as described or claimed herein or as illustrated in the figures, for instance, in a vertical stack arrangement or a horizontal relative arrangement. Of course, the steps of method 800 may be repeated to provide and arrange any suitable number of acoustic sound diffusers, for instance, such that a plurality of sound diffusers of a same configuration extend from a floor to a ceiling of a room or a portion therebetween.

One or more embodiments of the disclosed subject matter can also include the following:

(1) A sound diffusion system comprising: a first sound diffuser; and a second sound diffuser, wherein each of the first and second sound diffusers includes a first flat end, a second flat end opposite the first flat end, and a diffusive surface extending radially outward from a longitudinal axis of the sound diffuser and running in a direction of the longitudinal axis from the first flat end to the second flat end, wherein the second sound diffuser is in a stacked arrangement with the first sound diffuser, such that the first flat end of the second sound diffuser directly contacts the second flat end of the first sound diffuser, wherein the diffusive surfaces of the first and second sound diffusers have a same diffusive pattern, the diffusive patterns of the diffusive surfaces being aligned with each other in the stacked arrangement, and wherein each of the diffusive surfaces of the first and second sound diffusers extends in a circumferential direction relative to the longitudinal axis by at least 90 degrees.

(2) The sound diffusion system of (1), wherein the second sound diffuser is in a freestanding, stacked arrangement with the first sound diffuser.

(3) The sound diffusion system of (1) or (2), wherein the first flat end and the second flat end are identical or substantially identical.

(4) The sound diffusion system of any one of (1) to (3), wherein the diffusive surface runs in the direction of the longitudinal axis, continuously from the first flat end to the second flat end.

(5) The sound diffusion system of any one of (1) to (4), wherein the diffusive surface has an undulating pattern between the first flat end and the second flat end.

(6) The sound diffusion system of any one of (1) to (5), wherein the stacked arrangement is configured to be arranged so as to abut, contact, or be adjacent to an inside corner, an outside corner, or a flat wall.

(7) The sound diffusion system of any one of (1) to (6), wherein the stacked arrangement is configured to be arranged so as to abut, contact, or be adjacent to one of an inside corner, an outside corner, or a flat wall and reconfigured to be arranged to abut, contact, or be adjacent to another one of the inside corner, the outside corner, or the flat wall.

(8) The sound diffusion system of any one of (1) to (7), wherein the reconfiguring includes one of removing or adding a component of each of the first and second sound diffusers.

(9) The sound diffusion system of any one of (1) to (8), wherein each of the first and second sound diffusers is comprised of sound diffusive material.

(10) The sound diffusion system of any one of (1) to (9), wherein each of the first and second sound diffusers is hollow.

(11) The sound diffusion system of any one of (1) to (10), wherein each of the first and second sound diffusers is solid.

(12) The sound diffusion system of any one of (1) to (11), wherein each of the diffusive surfaces of the first and second sound diffusers extends in the circumferential direction relative to the longitudinal axis by one of 90 degrees, 180 degrees, 270 degrees, and 360 degrees.

(13) The sound diffusion system of any one of (1) to (12), wherein each of the first and second sound diffusers is formed of or consists of a single piece.

(14) The sound diffusion system of any one of (1) to (13), wherein each of the first and second sound diffusers is formed of or consists of multiple identical pieces.

(15) The sound diffusion system of any one of (1) to (14), wherein each of the first and second sound diffusers is formed of multiple identical pieces each centered around, sharing, or substantially sharing the longitudinal axis.

(16) The sound diffusion system any one of (1) to (15), wherein the first and second sound diffusers, in the stacked arrangement, have a pie shape or a pie piece shape in an overhead plan view.

(17) The sound diffusion system of any one of (1) to (16), wherein the first and second sound diffusers are identical.

(18) The sound diffusion system of any one of (1) to (17), wherein each of the diffusive surfaces of the first and second sound diffusers has an undulating pattern between the first flat end and the second flat end, the undulating pattern gradually increasing and decreasing along from the first flat end to the second flat end or vice versa.

(19) The sound diffusion system of any one of (1) to (18), wherein each of the diffusive surfaces of the first and second sound diffusers has a canyon therein.

(20) The sound diffusion system of any one of (1) to (19), wherein the canyon extends from the first flat end to the second flat end.

(21) The sound diffusion system of any one of (1) to (20), wherein each of the diffusive surfaces of the first and second sound diffusers has a plurality of alternating ridges and valleys extending from the first flat end to the second flat end.

(22) The sound diffusion system of any one of (1) to (21), wherein each of the diffusive surfaces of the first and second sound diffusers has a plurality of discrete or stepped portions of same geometric shape but different in size.

(23) The sound diffusion system of any one of (1) to (22), wherein each of the diffusive surfaces of the first and second sound diffusers has a plurality of discrete or stepped portions of different geometric shape.

(24) The sound diffusion system of any one of (1) to (23), wherein each of the diffusive surfaces of the first and second sound diffusers has one of a plurality of portions of same shape and size, a plurality of portions of same geometric shape but different in size, and a plurality of portions of same shape and size and same geometric shape but different in size.

(25) The sound diffusion system of any one of (1) to (24), wherein each of the diffusive surfaces of the first and second sound diffusers has a plurality of step portions.

(26) The sound diffusion system of any one of (1) to (25), wherein each of the diffusive surfaces of the first and second sound diffusers has an irregular surface pattern.

(27) The sound diffusion system of any one of (1) to (26), wherein each of the diffusive surfaces of the first and second sound diffusers extends in the circumferential direction relative to the longitudinal axis by 90 degrees, and wherein each of the first and second sound diffusers includes a first flat back wall and a second flat back wall meeting the first flat back wall at a right angle, the first and second flat back walls running in the direction of the longitudinal axis from the first flat end to the second flat end.

(28) The sound diffusion system of any one of (1) to (27), wherein the first and second sound diffusers are configured to be arranged in an inside corner such that the first flat back walls contact, abut, or are adjacent to a first wall defining the inside corner and the second flat back walls contact, abut, or are adjacent to a second wall defining the inside corner.

(29) The sound diffusion system of any one of (1) to (28), wherein each of the diffusive surfaces of the first and second sound diffusers extends in the circumferential direction relative to the longitudinal axis by 180 degrees, and wherein each of the first and second sound diffusers includes a first flat back wall running in the direction of the longitudinal axis from the first flat end to the second flat end.

(30) The sound diffusion system of any one of (1) to (29), wherein the first and second sound diffusers are configured to be arranged such that the first flat back walls contact, abut or are adjacent to a flat portion of a staging wall.

(31) The sound diffusion system of any one of (1) to (30), wherein each of the first and second sound diffusers is formed of or consists of two identical pieces.

(32) The sound diffusion system of any one of (1) to (31), wherein each of the diffusive surfaces of the first and second sound diffusers extends in the circumferential direction relative to the longitudinal axis by 270 degrees, and wherein each of the first and second sound diffusers includes a first flat back wall and a second flat back wall meeting the first flat back wall at a right angle, the first and second flat back walls running in the direction of the longitudinal axis from the first flat end to the second flat end.

(33) The sound diffusion system of any one of (1) to (32), wherein the first and second sound diffusers are configured to be arranged on an outside corner such that the first flat back walls contact, abut, or are adjacent to a first wall defining the outside corner and the second flat back walls contact, abut, or are adjacent to a second wall defining the outside corner.

(34) The sound diffusion system of any one of (1) to (33), wherein each of the first and second sound diffusers is formed of or consists of three identical pieces.

(35) The sound diffusion system of any one of (1) to (34), wherein each of the diffusive surfaces of the first and second sound diffusers extends in the circumferential direction relative to the longitudinal axis by 360 degrees.

(36) The sound diffusion system of any one of (1) to (35), wherein each of the first and second sound diffusers is formed of or consists of four identical pieces.

(37) The sound diffusion system of any one of (1) to (36), wherein the first sound diffuser is mechanically fixed or configured to be mechanically fixed to a portion of a wall above a ground or floor surface, the second sound diffuser being freestanding on the first sound diffuser in the stacked arrangement such that the first flat end of the second sound diffuser directly contacts the second flat end of the first sound diffuser.

(38) The sound diffusion system of any one of (1) to (37), wherein the first sound diffuser is freestanding on a ground or floor surface, the second sound diffuser being freestanding on the first sound diffuser in the stacked arrangement such that the first flat end of the second sound diffuser directly contacts the second flat end of the first sound diffuser.

(39) The sound diffusion system of any one of (1) to (38), wherein the first sound diffuser is mechanically fixed or configured to be mechanically fixed to a first portion of a wall, and wherein the second sound diffuser is mechanically fixed or configured to be mechanically fixed to a second portion of the wall above the first portion in the stacked arrangement such that the first flat end of the second sound diffuser directly contacts the second flat end of the first sound diffuser.

(40) A sound diffuser comprising: a body defining a first end, a second end opposite the first end, and a diffusive surface extending radially outward from a longitudinal axis of the sound diffuser and running in a direction of the longitudinal axis from the first end to the second end, wherein the diffusive surface extends in a circumferential direction relative to the longitudinal axis by one of 90 degrees, 180 degrees, 270 degrees, and 360 degrees, and wherein the first end and the second end are identical or substantially identical.

(41) The sound diffuser of (40), wherein the sound diffuser is configured to be arranged in a vertically stacked, direct contact arrangement with at least one other said sound diffuser and/or in a radial contiguous or horizontal contiguous arrangement with at least one other said sound diffuser, each of the sound diffusers having a same diffusive pattern.

(42) The sound diffuser of (40) or (41), wherein the sound diffuser is configured to be arranged in a vertically stacked, direct contact freestanding arrangement with at least one other said sound diffuser and/or in a radial contiguous or horizontal contiguous freestanding arrangement with at least one other said sound diffuser, each of the sound diffusers having a same diffusive pattern.

(43) The sound diffuser of any one of (40) to (42), wherein the first and second ends are flat.

(44) The sound diffuser of any one of (40) to (43), wherein the diffusive surface runs in the direction of the longitudinal axis, continuously from the first end to the second end.

(45) The sound diffuser of any one of (40) to (44), wherein the diffusive surface has an undulating pattern between the first end and the second end.

(46) The sound diffuser of any one of (40) to (45), wherein the body is configured to be arranged so as to abut, contact, or be adjacent to an inside corner, an outside corner, or a flat wall.

(47) The sound diffuser of any one of (40) to (46), wherein the body is configured be arranged so as to abut, contact, or be adjacent to one of an inside corner, an outside corner, or a flat wall and reconfigured to be arranged to abut, contact, or be adjacent to another one of the inside corner, the outside corner, or the flat wall.

(48) The sound diffuser of any one of (40) to (47), wherein the reconfiguring includes one of removing or adding another said sound diffuser relative to said sound diffuser.

(49) The sound diffuser of any one of (40) to (48), wherein the sound diffuser is comprised of sound diffusive material.

(50) The sound diffuser of any one of (40) to (49), wherein the body is hollow.

(51) The sound diffuser of any one of (40) to (49), wherein the body is solid.

(52) The sound diffuser of any one of (40) to (51), wherein the body is formed of or consists of a single piece.

(53) The sound diffuser of any one of (40) to (51), wherein the body is formed of or consists of multiple identical pieces.

(54) The sound diffuser of any one of (40) to (51) or (53), wherein the body is formed of or consists of multiple identical pieces each centered around, sharing, or substantially sharing the longitudinal axis.

(55) The sound diffuser of any one of (40) to (54), wherein the body has a pie shape or a pie piece shape in an overhead plan view.

(56) The sound diffuser of any one of (40) to (55), wherein the body is either symmetrical or asymmetrical.

(57) The sound diffuser of any one of (40) to (56), wherein the diffusive surface is symmetrical or asymmetrical.

(58) The sound diffuser of any one of (40) to (57), wherein the diffusive surface has an undulating pattern between the first end and the second end, the undulating pattern gradually increasing and decreasing along from the first end to the second end or vice versa.

(59) The sound diffuser of any one of (40) to (58), wherein the diffusive surface has a canyon therein.

(60) The sound diffuser of any one of (40) to (59), wherein the canyon extends from the first end to the second end.

(61) The sound diffuser of any one of (40) to (60), wherein the diffusive surface has a plurality of ridges and valleys extending from the first end to the second end.

(62) The sound diffuser of any one of (40) to (61), wherein the diffusive surface has a plurality of discrete or stepped portions of same geometric shape but different in size.

(63) The sound diffuser of any one of (40) to (62), wherein the diffusive surface has a plurality of discrete or stepped portions of different geometric shape.

(64) The sound diffuser of any one of (40) to (63), wherein the diffusive surface has one of a plurality of portions of same shape and size, a plurality of portions of same geometric shape but different in size, and a plurality of portions of same shape and size and same geometric shape but different in size.

(65) The sound diffuser of any one of (40) to (64), wherein the diffusive surface has a plurality of step portions.

(66) The sound diffuser of any one of (40) to (66), wherein the diffusive surface has an irregular surface pattern.

(67) The sound diffuser of any one of (40) to (66), wherein the diffusive surface extends in the circumferential direction relative to the longitudinal axis by 90 degrees, and wherein the body further includes a first back wall and a second back wall meeting the first back wall at a right angle, the first and second back walls running in the direction of the longitudinal axis from the first end to the second end.

(68) The sound diffuser of any one of (40) to (67), wherein the sound diffuser is configured to be arranged in an inside corner such that the first back wall contacts, abuts, or is adjacent to a first wall defining the inside corner and the second back wall contacts, abuts, or is adjacent to a second wall defining the inside corner.

(69) The sound diffuser of any one of (40) to (68), wherein the diffusive surface extends in the circumferential direction relative to the longitudinal axis by 180 degrees, and wherein the body further includes a first back wall running in the direction of the longitudinal axis from the first end to the second end.

(70) The sound diffuser of any one of (40) to (69), wherein the sound diffuser is configured to be arranged such that the first back wall contacts, abuts or is adjacent to a flat portion of a staging wall.

(71) The sound diffuser of any one of (40) to (70), wherein the body is formed of or consists of two identical pieces.

(72) The sound diffuser of any one of (40) to (71), wherein the diffusive surface extends in the circumferential direction relative to the longitudinal axis by 270 degrees, and wherein the body further includes a first back wall and a second back wall meeting the first back wall at a right angle, the first and second back walls running in the direction of the longitudinal axis from the first end to the second end.

(73) The sound diffuser of any one of (40) to (72), wherein the sound diffuser is configured to be arranged on an outside corner such that the first back wall contacts, abuts, or is adjacent to a first wall defining the outside corner and the second back wall contacts, abuts, or is adjacent to a second wall defining the outside corner.

(74) The sound diffuser of any one of (40) to (73), wherein the body is formed of or consists of three identical pieces.

(75) The sound diffuser of any one of (40) to (74), wherein the diffusive surface extends in the circumferential direction relative to the longitudinal axis by 360 degrees.

(76) The sound diffuser of any one of (40) to (75), wherein the body is formed of or consists of four identical pieces.

(77) The sound diffuser of any one of (40) to (76), wherein the body includes a back side configured to be mechanically fixed to a portion of a wall above a ground or floor surface.

(78) The sound diffuser of any one of (40) to (77), wherein the body is configured to stand freely on a ground or floor surface, by way of either the first end or the second end.

(79) The sound diffuser of any one of (40) to (78), wherein the diffusive surface is entirely flat between the first and second ends or includes one or more flat portions between the first and second ends.

(80) A method comprising: providing a first acoustic sound diffuser according to any one of (40) to (79); and arranging the first acoustic sound diffuser.

(81) The method of (80), further comprising: providing a second acoustic sound diffuser according to any one of (40) to (79); and arranging the second acoustic sound diffuser relative to the first acoustic sound diffuser such that the first and second acoustic sound diffusers either contact, abut, or are adjacent to each other.

(82) A method of manufacturing an acoustic sound diffuser according to any one of (40) to (79).

(83) A method of manufacturing a sound diffusion system according to any one of (1) to (39).

Having now described embodiments of the disclosed subject matter, it should be apparent to those skilled in the art that the foregoing is merely illustrative and not limiting, having been presented by way of example only. Thus, although particular configurations have been discussed and illustrated herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicants intend to embrace all such alternatives, modifications, equivalents, and variations that are within the spirit and scope of the present invention.

The invention claimed is:

1. A sound diffusion system comprising:

a first sound diffuser; and a second sound diffuser, wherein each of the first and second sound diffusers includes a first flat end, a second flat end opposite the first flat end, the first flat end and the second flat end being identical or substantially identical, and a diffusive surface extending radially outward from a longitudinal axis of the sound diffuser and running in a direction of the longitudinal axis from the first flat end to the second flat end, wherein the second sound diffuser is in a stacked arrangement with the first sound diffuser, such that the first flat end of the second sound diffuser directly contacts the second flat end of the first sound diffuser, wherein the diffusive surfaces of the first and second sound diffusers have a same diffusive pattern, the diffusive patterns of the diffusive surfaces being aligned with each other in the stacked arrangement, and wherein each of the diffusive surfaces of the first and second sound diffusers extends in a circumferential direction relative to the longitudinal axis by at least 90 degrees.

2. The sound diffusion system of claim 1, wherein the second sound diffuser is in a freestanding, stacked arrangement with the first sound diffuser.

3. The sound diffusion system of claim 1, wherein the diffusive surface runs in the direction of the longitudinal axis, continuously from the first flat end to the second flat end.

4. The sound diffusion system of claim 1, wherein the stacked arrangement is configured to be arranged so as to abut, contact, or be adjacent to an inside corner, an outside corner, or a flat wall.

5. The sound diffusion system of claim 1, wherein each of the diffusive surfaces of the first and second sound diffusers extends in the circumferential direction relative to the longitudinal axis by one of 90 degrees, 180 degrees, 270 degrees, and 360 degrees.

6. The sound diffusion system of claim 1, wherein each of the first and second sound diffusers is formed of or consists of a single piece.

7. The sound diffusion system of claim 1, wherein the first and second sound diffusers are identical.

8. The sound diffusion system of claim 1, wherein each of the diffusive surfaces of the first and second sound diffusers has one of a plurality of portions of same shape and size, a plurality of portions of same geometric shape but different in size, and a plurality of portions of same shape and size and same geometric shape but different in size.

9. The sound diffusion system of claim 1, wherein the first sound diffuser is freestanding on a ground or floor surface, the second sound diffuser being freestanding on the first sound diffuser in the stacked arrangement such that the first flat end of the second sound diffuser directly contacts the second flat end of the first sound diffuser.

10. A sound diffuser comprising:

a body defining a first end, a second end opposite the first end, and a diffusive surface extending radially outward from a longitudinal axis of the sound diffuser and running in a direction of the longitudinal axis from the first end to the second end, wherein the diffusive surface extends in a circumferential direction relative to the longitudinal axis by one of 90 degrees, 180 degrees, 270 degrees, and 360 degrees, and wherein the first end and the second end are identical or substantially identical.

11. The sound diffuser of claim 10, wherein the sound diffuser is configured to be arranged in a vertically stacked, direct contact arrangement with at least one other said sound diffuser and/or in a radial contiguous or horizontal contiguous arrangement with at least one other said sound diffuser, each of the sound diffusers having a same diffusive pattern.

12. The sound diffuser of claim 10, wherein the first and second ends are flat.

13. The sound diffuser of claim 10, wherein the diffusive surface runs in the direction of the longitudinal axis, continuously from the first end to the second end.

14. The sound diffuser of claim 10, wherein the body is hollow.

15. The sound diffuser of claim 10, wherein the body is solid.

16. The sound diffuser of claim 10, wherein the body is formed of or consists of a single piece.

17. The sound diffuser of claim 10, wherein the body is formed of or consists of multiple identical pieces each centered around, sharing, or substantially sharing the longitudinal axis.

18. The sound diffuser of claim 10, wherein the diffusive surface has an undulating pattern between the first end and the second end, the undulating pattern gradually increasing and decreasing along from the first end to the second end or vice versa.

19. The sound diffuser of claim 10, wherein the diffusive surface has a canyon therein, the canyon extending from the first end to the second end.

20. The sound diffuser of claim 10, wherein the diffusive surface has one of a plurality of portions of same shape and size, a plurality of portions of same geometric shape but different in size, and a plurality of portions of same shape and size and same geometric shape but different in size.

* * * * *